US009884241B2

(12) United States Patent
Ramirez

(10) Patent No.: US 9,884,241 B2
(45) **Date of Patent: *Feb. 6, 2018**

(54) PARTIAL FINGERED GLOVES FOR FOOTBALL OR GOLF PLAY

(71) Applicant: John C Ramirez, Redlands, CA (US)

(72) Inventor: John C Ramirez, Redlands, CA (US)

( * ) Notice: Subject to any disclaimer, the term of this patent is extended or adjusted under 35 U.S.C. 154(b) by 216 days.

This patent is subject to a terminal disclaimer.

(21) Appl. No.: 14/686,705

(22) Filed: Apr. 14, 2015

(65) Prior Publication Data

US 2016/0303462 A1 Oct. 20, 2016
US 2017/0333780 A9 Nov. 23, 2017

Related U.S. Application Data

(63) Continuation-in-part of application No. 14/664,808, filed on Mar. 21, 2015, which is a continuation of application No. 13/694,794, filed on Jan. 8, 2013, now Pat. No. 9,003,569.

(51) Int. Cl.

| | |
|---|---|
| ***A41D 19/00*** | (2006.01) |
| ***A63B 71/14*** | (2006.01) |
| ***A41D 19/015*** | (2006.01) |
| *A63B 102/32* | (2015.01) |

(52) U.S. Cl.

CPC ..... *A63B 71/141* (2013.01); *A41D 19/0017* (2013.01); *A41D 19/01547* (2013.01); *A63B 71/146* (2013.01); *A63B 71/148* (2013.01); *A63B 2102/32* (2015.10); *A63B 2243/007* (2013.01)

(58) Field of Classification Search

CPC ..... A41D 19/00; A41D 19/0013; A41D 19/0017; A41D 19/015; A41D 19/01523; A41D 19/01547; A41D 19/01552; A41D 19/01558; A41D 19/01564; A63B 71/14; A63B 71/141; A63B 71/146; A63B 71/148

USPC ..... 2/159, 160, 161.1, 161.2, 161.3, 161.8, 2/163

See application file for complete search history.

(56) References Cited

U.S. PATENT DOCUMENTS

| | | | | | |
|---|---|---|---|---|---|
| 2,025,710 | A | * | 12/1935 | Beemer | A41D 19/00 2/20 |
| 4,164,043 | A | * | 8/1979 | Fujita | A41D 19/00 2/161.1 |
| 5,500,956 | A | * | 3/1996 | Schulkin | A63B 71/148 2/159 |
| 5,528,772 | A | * | 6/1996 | Cheek | A63B 71/148 2/161.1 |
| 6,009,557 | A | * | 1/2000 | Witta | A41D 13/087 2/159 |

(Continued)

*Primary Examiner* — Jameson Collier

(57) ABSTRACT

According to the various features characteristics and embodiments of the present invention which will become apparent as the description thereof proceeds, the present invention provides partially fingered gloves and the use of said gloves, intended to increase the overall performance in sports activities including but limited to football and golf. Because of its unique finger configurations, grip enhancers, and/or its hand protective properties, the present invention makes a glove now operable on a football quarterback's throwing hand and on golfers dominant hand, for example.

13 Claims, 14 Drawing Sheets

(56) References Cited

U.S. PATENT DOCUMENTS 6,044,494 A * 4/2000 Kang ..... A41D 19/01547 2/161.1
6,189,150 B1 * 2/2001 Jones-Roberson ..... A41D 19/01529 2/159
6,209,137 B1 * 4/2001 Wallick ..... A41D 13/087 2/159
6,338,163 B1 * 1/2002 Markson ..... A41D 19/0017 2/161.6
7,735,153 B1 * 6/2010 Romiti ..... A41D 19/01558 2/161.6
9,003,569 B2 * 4/2015 Ramirez ..... A41D 19/01547 2/161.1
2004/0025224 A1 * 2/2004 Albert ..... A63B 71/148 2/159
2004/0107476 A1 * 6/2004 Goldwitz ..... A41D 19/015 2/159
2005/0268373 A1 * 12/2005 Winningham ..... A41D 19/015 2/163
2006/0185058 A1 * 8/2006 McGough ..... A63B 71/148 2/163
2007/0079421 A1 * 4/2007 Davis ..... A63B 69/00 2/163
2008/0229477 A1 * 9/2008 McGough ..... A41D 19/01547 2/161.1
2009/0025120 A1 * 1/2009 Vestling ..... A41D 19/015 2/161.1
2010/0077526 A1 * 4/2010 Smeltzer ..... A63B 71/148 2/16
2010/0313332 A1 * 12/2010 Denis ..... A63B 71/141 2/162
2011/0113521 A1 * 5/2011 Bradford ..... A41D 19/01582 2/19
2011/0258754 A1 * 10/2011 DuPont ..... A41D 19/0017 2/161.1
2013/0281234 A1 * 10/2013 Ramirez ..... A41D 19/0013 473/415
2014/0189925 A1 * 7/2014 Ramirez ..... A41D 19/01547 2/16
2014/0373251 A1 * 12/2014 Ramirez ..... A63B 71/146 2/161.3
2015/0059052 A1 * 3/2015 Ramirez ..... A63B 71/146 2/161.2
2015/0143607 A1 * 5/2015 Ramirez ..... A63B 71/146 2/161.3
2016/0360809 A1 * 12/2016 Ramirez ..... A63B 71/146

* cited by examiner

PARTIAL FINGERED GLOVES FOR FOOTBALL OR GOLF PLAY

FIELD OF THE INVENTION

The present invention relates to sports apparatus and equipment, and uses thereof, used in playing the game of various sports. The present invention and its multi-sport glove embodiments enhance the overall performance in athletic tasks and/or execution commonly associated during sports play, particularly in, but not limited to, football and golf by configuring to meet the specific requirements of a football quarterback's throwing hand and a golfer's dominant hand, for example. The present invention finger configurations completely cover the thumb and forefinger of a user's hand. Additionally, the present invention leaves essentially completely uncovered the user's ring finger, pinkie finger and middle finger.

Furthermore, the present invention offers improvements in the form of grip enhancers on the palm area, the thumb segment and/or on the existing forefinger segment. Additionally, the present invention may offer protective properties on the dorsal segment of the glove.

BACKGROUND OF THE INVENTION

An important goal in playing sports in to win. Often that means proper play execution, good ball control, good grip and feel, and proper form in the sports fundamentals. Gloves and other types of hand covers are permitted in most sports. Many individuals use gloves to enhance, in some way, their competitive edge. Indeed, gloves have become so important that different types of gloves have been created for different sports. Even within a sport, different types of gloves have been invented to, among other things, maximize performance in specific tasks.

In football, for example, there are gloves that offensive and defensive Tackles can wear, that have thick padding around part of the hand. Offensive Receivers can purchase more expensive, all closed-finger, thin gloves to enhance their ability to catch and grip a football.

The use of gloves in football is so widespread that nearly every football player uses them, with the notable exception of football quarterbacks. You rarely see a quarterback wear gloves, even if just to keep warm. Most quarterbacks choose to play football without gloves, especially on their dominant (throwing) hand. This is largely because prior art consists of generic full-fingered gloves which are uncomfortable and burdensome on a quarterback's throwing hand, particularly on those fingers a quarterback places over the football laces. In addition, the full-fingered gloves prevent a quarterback to have any significant 'feel' of the football.

This ability to feel is critical when playing the position of quarterback. When the quarterback receives the ball from the teammate playing the Center position, the quarterback especially during a pass play, has to quickly find the laces on the football by feeling and not looking at the football. The quarterback has to look for an open player to pass to, and cannot therefore look down at the football to find the football laces.

This need to 'feel' a ball with a hand has therefore resulted in quarterbacks having to make a difficult choice. Although clearly these players would benefit from added grip enhancers on the throwing hand to increase their passing receptions or to decrease fumbles, for example, prior art gloves force a quarterback to choose between all feel and no feel. Virtually all quarterbacks have chosen to maintain feel and therefore sacrifice the ability to better grip the football. It is no surprise that quarterback fumbles remain a significant problem in football, even at the highest performance levels, and currently remains an insoluble problem in the sport for amateurs and professionals alike.

Playing the position of quarterback without the help of gloves, however, can also be an inferior choice. The website 'Wikihow' provides a good description of the conventional way to hold and throw a football. "Throwing the football is simple. Put your non-throwing side foot in front of you. Have your pinkie, ring and middle fingers around the laces with your Index [forefinger] finger on the strap. Put the other hand up on the ball. Put the ball up by your ear. Twist your hips toward the front foot. Throw the ball at the receiver."

Whereas the fingers over the laces have a solid grip on the ball—primarily due to the football laces on the ball—the two fingers off the laces (forefinger and thumb) are virtually unsupported and therefore have a relatively weaker grip, creating a weak overall grip on the football (see FIG. 7 for an example of how a quarterback typically grips a football).

This weak overall grip becomes more pronounced when added stress is placed on the thumb or forefinger. When a quarterback, intending to pass the football, suddenly has to scramble, or if the quarterback 'pumps' the ball (goes through all the motions and speed of throwing the ball but doesn't actually release the ball), the grip strength of the thumb and forefinger can determine whether or not a quarterback fumbles the football.

Unfortunately, one need only view the statistics to see that fumbles persist as an insoluble problem, even at the professional level today. In the 2010 National Football League (NFL) season, there were only ten players who had 9 or more fumbles in the season. All ten players were quarterbacks (The Official '(NFL™)' Record & Fact Book, 2011).

Under the 'tips' section of 'Wikihow', it further describes proper football throwing form: "A proper throw will feel like it's only utilizing the thumb, Index [forefinger], and middle finger. Good release will 'roll' off of your Index and middle finger, to impart more spin; you may snap your wrist through as you follow through to the hip. The other three fingers on your hand stabilize the ball as its being flung. They should not be used to impart spin on the ball. The most important finger to throwing a spiral is the Index finger; it is the finger that holds the most leverage in putting spin on the ball" [Emphasis added]. The conventional way of playing the position of quarterback therefore requires an ability to have solid grip and control with the forefinger, a finger that is not able to be placed over the football laces; the resulting glove-less grip creates a strong hold on the ball by all the fingers except the thumb as well as the forefinger—the most important finger when throwing a football. On a wet football field, during extreme weather conditions (hot or cold), that weaker or looser grip makes for a much more difficult completed pass, less success at throwing a spiral, and inconsistency and inaccuracy in passing.

Passing the ball is a significant part of the sport of football, sometimes throwing as much as 103 times in a single game (e.g., Seattle vs. San Diego, 2002). Thus, developing a solution to enhance one's ability of better controlling a football and completing a pass reception would substantially impact the sport.

There have been some attempts through the years to solve the problems of inconsistencies and turnovers in the sport of football. For example, changes have been made to the actual football in order to make the ball easier to handle. Changes to the shape and size, as well as the addition of grip enhancing materials to the ball—such as the addition of 'PolyVinyl Chloride (PVC)' dots—have made it possible to make the ball more grippable. The ability of the quarterback to maintain control of the football was still problematic because of the lack of any grip enhancing device for the player to use; gloves that could be placed on the throwing hand such that the football quarterback could now more significantly control a ball with his arm, thereby creating an overall grip of the football throughout the football. As a result of this unmet need, inconsistencies and turnovers were still high in the sport.

The introduction and subsequent proliferation in the use of gloves found some success but even with these advancements, however, fumbles and incompletes still persist today, partly because none of the prior art gloves could be useful, and are therefore inoperable to quarterbacks.

Consequently, there is also a need for a sport glove of some kind which permits the quarterback to hold a football more securely. These problems may be addressed by providing a new sports glove that is configured to properly address the grip and feel requirements of the throwing hand of a quarterback.

Quarterbacks are also now starting to intentionally run more (hereinafter called 'rushing') with the football creating an even greater need to configure a glove to meet the specific needs of a quarterback. New art is required that can offer superior grip enhancing abilities, critical not only in ball control, but also in quarterback rushing successes.

Quarterback injuries can become a big problem in the sport, for example. Protecting the quarterback from injury is so important that rules have been established to try and minimize those injuries. Gloves have proved useful in protecting other users, but prior art gloves have not been configured for use by quarterbacks. To be sure, many quarterback injuries take place on the quarterback's throwing hand, primarily on the back portion of the hand, on the side of the hand or palm area, or on the fingers of the throwing hand.

Prior art configuration problems cease to protect a quarterback's throwing hand. As is well known, repeated exposure to hand injury can cause damage to the systems of the hand, such as the nervous system, the muscular system or the skeletal system. Therefore, there is not only an opportunity for new art, but there an increasing concern and need to solve this configuration problem, not only for professionals but also for children and teenagers playing this football position. Consequently, there is also a need for a protective sport glove of some kind which permits the quarterback to hold a football securely and still provide adequate protection of the throwing hand against impacts from opposing players.

Over the last decade or two, quarterbacks have increasingly chosen to rush for yardage and act more like a running back at times. The top five 'NFC™' Conference quarterbacks, for example, rushed for a total of 1,562 yards in the 2010 season. It is also no surprise, therefore, that there were a total of 731 fumbles in the NFL that season, and fully over 25% of those fumbles were attributed to quarterbacks (2010 'NFL™' Season). As this trend continues, especially with more popular offensive formations such as 'the wildcat' and 'spread' formation, these grip-enhancing shortcomings will undoubtedly be more pronounced. Previous failures of others to create gloves to support a quarterback's grip, not only while throwing the football but also while rushing with the football, is becoming a growing significant problem in need of a solution.

Given the fact that fumbles and incomplete passes persist at the professional level and therefore certainly at the collegiate and amateur levels, one can see that past attempts to solve these problems have had limited success, at least partly because prior art still have not solved the configuration problems. There is therefore a need for significant advances in the sport of football to assist quarterbacks, a position that touches and controls the football more than any other position in the sport. New art needs to be offered, such as the present invention, to meet the needs of quarterbacks by developing a glove that is configured to meet the unique needs of that position.

In the field of GOLF, to be sure, there exists much prior art in the form of gloves for a golfer's weak (non-dominant) hand. In fact, most active golf players wear a glove on their weak hand, and go without a glove for their strong hand (if one were to go to any major store to buy golf gloves, they would be sold and packaged in single—one glove—not sold in pairs). Gloves are prevalent in golf largely because of the role that hand grip plays in a golfer's overall performance.

Whereas weak-hand support products seem to be crowded in the sport of Golf, there is a long existing need for a device that could offer added support for a golfer's strong hand without significantly diminishing its ability to adequately feel the golf club. Inventing a solution to this problem could, among other things, allow for greater golf swing control and consistency, and create an entirely new market to support a golfer's strong-hand.

There is therefore, an opportunity to invent a device that could offer some 'feel' ability for the dominant hand, while significantly enhancing the grip ability of that same hand. This would increase overall hand control of a golfer's club swing by allowing a golfer to have added grip capabilities on both hands, and therefore greater success in competition.

In Golf magazine's April 2005 article titled "Fix Your Grip," golf instructor Charlie King provides an overview of how to grip a golf club. "Good golf starts with your grip. The proper hold on the club helps you do three crucial things: Hinge your wrists, control the clubface at impact and support the club throughout the swing. Here are three simple grip tips." As King continues, his third tip is "both hands; solid at the top. An effective grip sets the face square at the top, with the shaft parallel to the target line. You should feel most of the club's weight in your left thumb and right forefinger. Now you're ready to turn it loose." Although prior art seems to be crowded in offering a glove for the weak-hand to support and better control the club weight placed on the thumb of the weak hand, there remains an unmet need for added support on or around the forefinger of the strong (dominant) hand. Additionally, constant swinging of a golf club at real swing speeds often results in soreness on and between the thumb and forefinger of a golfer's strong hand wearing no glove. This soreness can often also come from the rubbing or slipping between the club handle and the portion between the thumb and forefinger of the strong hand, suggesting a need to find a way to increase the grip of a golfer's strong hand. This is especially important in the sport of golf because even the smallest of slipping—during the golf swing or upon impact of the golf ball—can create enormous inconsistencies and inaccuracies, critical issues in determining overall performance in golf.

A further reason why golfers are not using gloves on their dominant hand has to do with the fact that golf gloves are not uniquely configured to best conform to a golfer's preferred golf grip. For example, golfers are not using gloves on their dominant hand because the dominant hand's pinkie finger is often used to touch and feel the non-dominant hand when holding the golf club using the traditional overlap grip; this is done to help with the coordination of movement of both hands to preferably act in unison throughout the golf swing.

Therefore, at least a portion of the dominant hand's pinkie finger must be uncovered in order to maintain necessary feel. Because the dominant hand is responsible for most of the feeling in the golf swing, it also becomes necessary to maintain some level of high sensitivities on a portion of the dominant hand's ring finger and middle finger as well. A preferred configuration for the golfer's strong hand would be, for example, a glove which could increase the grip capabilities of the dominant hand's thumb and forefinger, while offering some level of feel along the middle finger, the ring finger and the pinkie finger, thus offering the ability of a wearer to simultaneously have significant grip and feel of a sports apparatus such as football or golf club.

Consequently, there are clear indications that an entirely new market exists for a device that could support a golfer's strong hand. In particular, there remains an unmet need that would provide multiple benefits, such as better overall grip and more coordination with both hands during the practice or play of golf, and in various other sports activities. The present invention solves the above mentioned problems by, among other things, providing a glove configured for use on the dominant hand that can increase grip abilities on areas primarily responsible for the gripping a golf club, improving prior art gloves by offering grip enhancers along critical areas of the glove, while allowing portions of the other fingers to be uncovered and able to maintain necessary feeling capabilities.

DETAIL DESCRIPTIONS OF THE INVENTION

The present invention provides a glove having dorsal (back) and palmar (front) portions for overlaying respective back and palm regions of a human hand, and dorsal and palmar portions having distal and proximal ends with a plurality of digital segments (or stalls) projecting from said distal ends. Additionally, three separate openings or ringlets are provided on said distal ends, such that a user's ring finger, pinkie finger and middle finger may individually extend through said glove.

The glove includes a glove body having a back portion surface covering the back of the hand, and a front portion surface covering substantially all of the palm of the hand. The glove body includes one finger stall (or finger digital segment) and a thumb stall (or thumb digital segment) each adapted to receive a forefinger and thumb, respectively, therein. The glove body is configured such that the thumb and forefinger digital segments fully enclose said thumb and forefinger, including enclosing the fingertips. Additionally, the glove body provides three separate openings or ringlets such that a user's ring finger, pinkie finger and middle finger may individually extend through said glove body when placed on a user's hand, thereby allowing a user's pinkie finger, ring finger and middle finger to be all essentially completely uncovered while enclosing a user's thumb and forefinger.

In another preferred aspect, the present invention also comprises a Grip Enhancing Means, such as a plurality of projections comprising of PVC dots, for example, on a portion or portions of the palmar surface area of the glove, such as for example, on any thumb and finger stalls, along any portion of any metacarpophalangeal joints of said glove body, and/or between the thumb and forefinger area, generally defined by the metacarpal of the forefinger and extending up along the metacarpal of the thumb, and therebetween.

In at least one embodiment, the entire palmar surface comprises of a Grip Enhancing Means throughout said palmar surface. The Grip Enhancing Means permits the individual, for example, to better grip a ball or an object or device, and can create, for example, a higher coefficient of friction on the select palmar portion of the glove compared to the rest of the glove body. This could give, for example, a football quarterback or a golfer multiple benefits such as increased control of a ball or device thereby enhancing performance and overall success at performing a sports task.

Accordingly, embodiments provide a novel glove with added features that enhances overall control in sports performance.

In another preferred aspect, the present invention also comprises protective properties to protect a user from injury or to protect an injury. These protective properties can be in the form of a thicker dorsal segment compared to the palmar segment, or in stronger material that comprises the dorsal segment of the glove. Additionally or alternatively, a Shock-Absorbing Member or members, such as a padded layer or layers may be used so that the glove can be used to protect an injury or to protect an area from being injured, for example.

The Shock-Absorbing Member or members are generally located on the dorsal segment of the glove, preferably covering at least a portion of the metacarpal of any of the four fingers and/or the thumb, and/or on substantially the dorsal portions of the thumb and/or on the existing forefinger segment, where many football injuries occur as a quarterback throws a football and is immediately hit by an opposing player. Also, some embodiments may have a Shock-Absorbing Member or members near and around the wrist area, extending up to as much as about five inches along the carpal bone of the wrist of a user. The Shock-Absorbing Member may generally be affixed to the outer surface of the glove dorsal segment or may be integrally formed on the glove. If integrally formed, at least one embodiment may therefore include a liner.

The thickness and dorsal surface locations of the Shock-Absorbing Members may vary, of course, depending on preference. In at least one embodiment the entire dorsal segment comprises a Shock-Absorbing Member, and the Shock-Absorbing Member can be one uniform cushion, for example, mirroring the design of the dorsal segment of the glove.

The Shock-Absorbing Member may comprise of a pad or pads, such as any foam or cotton-based fabric, for example that provides a cushion to protect the selected areas of the hand. The Shock-Absorbing Member is preferably at least six hundred micrometers in thickness; more preferably the Shock-Absorbing Member is at least three millimeters in thickness.

Accordingly, embodiments also provide a novel glove with added protective features that enhances protection of a previously unprotected quarterback's throwing hand, for example, including the back of the hand, the thumb and forefinger, and wrist areas, and combinations thereof.

The glove may also have an expandable opening means at a wrist end adapted to receive the user's hand. This may comprise of a wrist portion with a securement opening means, such as but not limited to a flap which mechanically engages a flap capture mechanism to secure the glove to the users hand (e.g., a synthetic hook and loop fastening interface which adheres when pressed together, commonly using 'VELCRO™'). In this case the flap could overlay a small slit or opening along a portion of the glove back overlaying the user's hand to allow the glove to widen when a user places the glove onto the hand. Alternatively, the opening means may comprise of other standard used mechanisms of allowing a user to apply and disengage the glove, such as an elastic band material along the wrist portion.

Embodiments may also comprise of micro holes or micro recesses along any portions of the glove, generally used on golf gloves and football gloves for ventilation or moisture management purposes. These micro holes or micro recesses are generally about 0.120 millimeters in diameter.

Construction of the present invention may be accomplished by standard methods, such as, for example, by designing the dorsal and palm sections to meet along a conjoining lateral edge to define a pocket for receiving the eminence of a user's hand, and sewing said sections together.

One sport where the present invention will clearly enhance performance is in the sport of FOOTBALL. As previously discussed, wearing a glove can be very advantageous, and is used by most athletes in most sports activities. Prior art gloves, as previously configured however, were essentially inoperable on a football quarterback's throwing hand, or on a golfer's dominant hand. Using embodiments of the present invention now allow a football quarterback to place his covered thumb and forefinger on the football and increase the grip by the glove embodiment and its targeted grip enhancers, and be able maintain maximum tactile abilities by leaving unencumbered his middle finger, ring finger and pinkie finger, for example. This configuration and other embodiments allow the quarterback the ability to place the uncovered middle finger, ring finger and pinkie finger over the football laces unencumbered and also able to maintain significant feel on the football, by not being covered by a glove. This and other new features now essentially make the sports glove more operable, novel and significantly superior to prior art in these areas.

This finger configuration will allow a quarterback to increase his grip and overall control of a football while simultaneously allowing some finger feel of the football. The rest of the hand, front and back, could be completely covered by the glove. Additionally, the embodiment will have a palmar and dorsal portion overlaying at least a portion of the wrist area. For example, the wrist portion could be stitched on the glove and be made of an expandable composition whereby the glove would expand when being placed on a hand, and then naturally readjust to fit snugly around the user's wrists.

This glove will take into account the benefits of the laces on a football and give a quarterback the unique ability to grasp a football over the football laces with the comfort and feel of not having a glove, while adding the support that a glove provides over the thumb and forefinger, particularly over the fingertips of the thumb and forefinger. Improvement in throwing accuracy and overall performance will result from this unique type of support provided by the new art.

One critical element of the present invention is the three separate openings or ringlets or recesses, at the distal portion of the glove body whereby a user's middle finger, ring finger and pinkie finger may each extend through said glove body and thereby completely exposing the entire middle finger, ring finger and pinkie finger of a user. In other words, one opening is configured to allow only a user's middle finger to extend through the glove body thereby completely exposing a user's middle finger; another separate opening is configured to allow only a user's ring finger to extend through the glove body thereby completely exposing a user's ring finger; still another opening is configured to allow only a user's pinkie finger to extend through the glove body thereby completely exposing a user's pinkie finger.

Among the many benefits of providing three separate openings as opposed to simply providing one large opening large enough such that all three said fingers would extend through (such as an open mitten or gauntlet structure) include: minimizing glove movement while throwing a football or when moving the gloved hand with high velocity, and maintaining a stable grip of a football when an opposing football player impacts a user's gloved hand while rushing with a football.

By providing three separate openings the present invention's glove body essentially overlay's the portion of a user's hand between the middle finger's proximal phalanx and the ring finger's proximal phalanx, and the portion of a user's hand between the ring finger's proximal phalanx and the pinkie finger's proximal phalanx.

This embodiment could also find significant usefulness in GOLF as well. When placed on a golfer's dominant hand, the golfer can then use the overlapping grip, for example, and still maintain the necessary feel between the dominant hand's pinkie finger which would remain uncovered and which overlays and is in direct contact with the non-dominant hand's forefinger. One of the added benefits of using the embodiment is that the user would now have enhanced grip on the dominant hand's thumb and forefinger, which is currently glove-less. The dorsal surface and the palmar surface of the glove may preferably generally mirror each other in configuration, thereby making conjoining relatively simple to form the glove.

Additionally, the embodiment could comprise a Grip Enhancing Means on the glove portion overlaying the entire metacarpophalangeal joints of the pinkie finger, ring finger, middle finger and forefinger, a critical area in controlling a ball or sport device. For example, the location of this Grip Enhancing Means may be defined by the four finger digital creases and extending down about three centimeters (width), enough to cover the entire metacarpophalangeal joints of said fingers in their entirety. The length would be defined by the two opposing sides of the palm, say about seven to ten centimeters in general. This area would then include, for example, a high friction surface or a textured surface, as the Grip Enhancing Means. The Grip Enhancing Means could be comprised of a beaded surface pattern projecting out at least ½ millimeter, and which could be integral to the glove material and would preferably extend throughout the entire designated surface area, but could certainly be provided on at least one centimeter by one centimeter along the designated palmar outer surface to provide added grip support, such as, for example, only on the metacarpophalangeal joint of the forefinger. The Grip Enhancing Means would thereby offer significant improvements to prior art partial fingered gloves.

The embodiment could also offer a Grip Enhancing Means on the palmar side of the existing finger stall as well as the thumb stall, preferably on a portion of one or any of the proximal phalanges of the finger and thumb stalls, thus defining the terminal edges of the Grip Enhancing Means for the embodiment.

In general, the Grip Enhancing Means of the present invention may be integral to the glove or may be affixed by forming a grip enhancing panel and applying the panel onto a portion of the glove. The finger Grip Enhancing Means of this embodiment could comprise, for example, a high friction textured surface with a more narrow width, say about 1.5 to three centimeters. This and other embodiments may include a plurality of projections on the surface as the Grip Enhancing Means formed from, for example, one of a vinyl material, a rubber material, or a neoprene material, creating a grip enhancing panel.

The material forming the panel could then be applied to said digital stalls using any standard bonding methods, such as adhesion or stitching. The plurality of projections would preferably be provided, for example, on at least one centimeter by one centimeter of any digital segment stalls. The projections could preferably extend out less than 1/10 of a centimeter, but could range generally from 1/20 of a centimeter to several centimeters.

The present invention can now provide glove embodiments that can also protect a user's hand such as a quarterback's throwing hand. The embodiment described above, can further comprise, for example, a Shock-Absorbing Member along the dorsal portion overlaying the metacarpals and/or on the dorsal area of the existing finger and thumb stalls. The Shock-Absorbing Member of this and other embodiments could comprise of a pad or pads, such as any foam or cotton-based fabric, for example that provides a cushion to protect the selected areas of the hand. The padding can extend along at least a portion of the dorsal segment of the glove. This embodiment, for example, comprises foam padding that overlay and is bounded by the four metacarpals of the pinkie finger, the ring finger, the middle finger and the forefinger. Additionally, this embodiment comprises foam padding that overlay and is separately bounded by the proximal phalanx of the forefinger, thus defining its terminal edges (the phalanx and generally the dorsal surface of the glove). The Shock-Absorbing Members can be operably attached to the glove, for example. The foam pads each can be about six millimeters or so in height, each encased in separate, preferably flexible materials, such as flexible plastics or synthetic cottons. Other embodiments may have various heights, of course. The encased pad, for example, can then be stitched on to their respective locations, as described. Each of the encased paddings can be one or a plurality of small cushions. The paddings can be stretchable and elastic.

The present invention solves the configuration challenges of prior art and now makes the athletic glove operable for use by quarterbacks using conventional methods of controlling a football. The present invention now therefore also offers a new method of playing the position of quarterback. When throwing a football, for example, the quarterback will first place the present invention partial-fingered glove on his throwing hand. After receiving the football from the Center, he will look down the football field while using primarily his uncovered fingers to feel and locate the football laces on the football. After locating the football laces, he will quickly place the uncovered portion of his ring finger, pinkie finger and perhaps his middle finger over the football laces, thus creating a solid grip over the top and distal half of the football. The quarterback will place his now covered forefinger and thumb on the closer half of the football, thus creating a solid grip throughout the entire football. The quarterback then locates a teammate to throw the football and proceeds to throw the football. The quarterback's forefinger, supported by a glove and its grip-enhancers, will now be able to more properly release the football—or more properly spin the football with his now grip enhanced forefinger—and deliver the football to the intended target more accurately.

In addition to offering greater throwing accuracy and consistency, these and other embodiments should also help minimize quarterback fumbles by adding support when 'pumping' the ball, when scrambling from being tackled, and when rushing and throwing the football. When in 'shot gun' formation especially, a quarterback must quickly look down field at his receivers and 'feel' for the football laces. The present invention will allow a quarterback to maintain a heightened sense of feel from his middle finger and ring finger, while increasing the grip support on his thumb and forefinger. This significant and substantial feature will, among other things, enhance grip and control while maintaining or even enhancing overall feel.

With quarterback fumbles reaching as high as 23 fumbles in a single season (Kerry Collins, 2001) these and other grip enhancing embodiments for football quarterbacks will significantly impact the sport of football.

If preferred, for example, embodiments may provide added grip capabilities along the palmar portion on and between the thumb stall and the forefinger stall. By providing added grip support on this area of the glove body, a quarterback will have further increased control of the football to better perform common tasks. For example, when a quarterback wants to throw the football but has to temporarily run, or scramble, to avoid being tackled the quarterback most often relies primarily on only the dominant hand to hold on to the football. This added grip enhancers now allow the quarterback to more securely hold the football in the throwing position while scrambling by providing added grip capabilities in select areas, and can throw the football with greater precision while scrambling if necessary.

The targeted Grip Enhancing Means may also preferably overlay any thumb or finger, any of the metacarpophalangeal joints, or on any portion between the thumb and forefinger, and may be separately the only grip enhancers on the embodiment, may be used in combination, or may be throughout the palmar surface.

This and other embodiments offer superior grip capabilities, critical not only in overall ball control and passing the football, but also in quarterback rush attempts. Over the last decade or two, quarterbacks have increasingly chosen to rush for yardage and at times act more like a running back. Throughout his years in the NFL, for example, professional football quarterback Michael Vick has attempted over 650 rushes. More recently, 'NFL™' quarterback Tim Tebow had 43 rush attempts in a season, with an average of over 3.16 yards per carry.

Clearly, the trends suggest that the successful quarterback will be required to rush more with the football the result will often mean getting hit on his dominant hand, which is usually covering to protect the football. Largely because of this, individuals playing the position of running back almost all wear gloves to be able to maintain control of the ball during impact and not fumble the football; now with quarterbacks starting to become the second leading rushers on their respective teams (Tebow, Denver Broncos, 2010) the need for the quarterback to wear the present invention on his dominant hand grows even higher. Embodiments may also offer critical added protection over the dominant hand of a quarterback, for example, for several reasons such as being better able to absorb impact by opposing players.

Embodiments of the present invention offer football quarterbacks many benefits including:

- stronger overall grip
- higher completed pass accuracy
- more success at throwing a spiral
- higher consistency and performance in ball handling and control
- better control resulting in less fumbles
- greater success at quarterback play execution added protection, by the Shock-Absorbing Member, on select areas of the hand.

greater success when a quarterback runs/rushes with a football grip enhancers on the throwing hand of the quarterback targeted grip enhancers specifically designed to maximize quarterback performance significant enhanced and vital protection to a quarterbacks throwing hand protection on the throwing hand when the quarterback rushes with the football In football, unstable or weak ball control can, among other things increase fumbles, increase incompletes and thereby increase turnovers and decrease performance. The above features offer significant and substantial benefits which properly address the concerns currently facing those many athletes, such as football quarterbacks.

Another sport where the present invention will fulfill an unmet need is in the sport of GOLF. Embodiments of the present invention can be configured to meet the unique requirements of a golfer's strong hand thereby providing new art. A preferred embodiment comprises a glove with a thumb stall that covers all of the thumb finger, and a forefinger stall that covers all of the forefinger. Additionally, the middle finger, ring finger and pinkie finger are each completely uncovered thereby maintaining the necessary feel in a preferred grip method.

This embodiment will now allow a golfer to use his conventional golf glove on his non-dominant hand, as is currently done, while now using the embodiment on his dominant hand as well. The uncovered pinkie finger allows the golfer to maintain heightened feel in the pinkie finger, necessary in coordinating both hands throughout the golf swing while using any of the conventional club gripping methods, such as the overlapping, interlocking or even the full-fisted method.

When using the conventional overlapping method, for example, the pinkie finger of the dominant hand is placed over the forefinger and middle finger of the non-dominant hand, so using this embodiment will allow the user to maintain maximum tactile sensation of the pinkie finger and properly coordinate a golf swing. Additionally, the golfer will now also have added grip capabilities along the covered thumb and forefinger of the dominant hand. A Grip Enhancing Means could also be formed on said digital segment stalls or along the metacarpophalangeal joints if preferred, thus providing added grip capabilities along the area where the club is gripped. For the same reasons, this embodiment would significantly assist golfers using any of the interlocking or full-fisted methods as well.

Among the benefits of the present invention include the ability to offer greater golf consistency and accuracy by solving an unrecognized problem in prior art. Using this embodiment on the dominant hand in conjunction with a standard golf glove on the non-dominant hand will allow the user to maximize grip at both ends of the club while maintaining feel capabilities to coordinate swing and feel if the golf club moves during a golf swing. For example, the Grip Enhancing Means may comprise of stripes, for example, projecting out about 600 micrometers, along any of the designated areas.

A significant improvement to this embodiment may also comprise a Grip Enhancing Means along any or all of the metacarpophalangeal joints, and/or on any of the thumb and forefinger stalls, and/or on any region between the thumb and forefinger. When using the interlocking grip method the Grip Enhancing Means may comprise a non-slip latex coating, for example, and would be especially useful along the pinkie finger's metacarpophalangeal joint, the area just below where the weak-hand forefinger interlocks with the strong hand pinkie finger defining the terminal edges of this Grip Enhancing Means. The thumb and forefinger stalls could also comprise tiny recesses or holes generally used on golf gloves, for ventilation or moisture management purposes.

This embodiment could be in the form of a standard synthetic leather golf glove, with the dorsal and palmar surface areas essentially covering all five metacarpals, with the only exception of a slit along the dorsal surface which allows the golfer to insert the hand into the glove, and micro recesses along a portion of the glove to allow for ventilation.

Many using the interlocking grip generally do so to maximize feel and hand coordination, thereby interlocking their weak-hand's forefinger with their strong-hand's pinkie finger. This embodiment, and others, can allow a golfer to use the interlocking method to provide added grip capabilities of the dominant hand without losing necessary tactile sensations in coordinating hand movements. This embodiment, for example, would provide significantly enhanced grip capabilities thereby creating a more unison golf swing. The uncovered middle finger will allow the golfer to still have significant feel on said finger, while still being able to increase the overall grip along the palmar portions of the metacarpophalangeal joints, and the thumb and forefinger areas. Configuring a golf glove for the strong hand will, among other things, create a solid grip throughout both hands, thus satisfying an unmet need. This embodiment, of course would also prove useful for football quarterbacks for the reasons aforementioned.

The Grip Enhancing Means of the present invention creates a higher coefficient of friction on the palmar segment of the glove than what the skin of a user would otherwise provide, and can be comprised of various grip-enhancing materials, forms, coatings, and designs, including but not limited to, a plurality of regular or irregular projections, a plurality of regular or irregular depressions, foams, fabrics, PVC dots, perimeter patching designs, linear and non-linear grooves, or combinations thereof, high friction surfaces, textured surfaces, non-slip materials and coatings, such as PVC coatings and latex coatings, and designs creating coarse surfaces such as eighty grit emory cloth for example, as well as pebbled or beaded surfaces, convex or concave bumps, striations, cross-hatches, convex or concave linear and non-linear lines, angled ribs, random structures, convex or concave ridges, crevices, elongated segments, and the like. Preferably, the depths of the depressions and/or heights of projections would be such that the gap formed by the depressions or projections would allow for some movement of the palmar surfaces thereby increasing the grip capabilities of the user. The heights of the projections and the depths of the depressions range from about 100 micrometers to several millimeters; more preferably the heights of the projections or the depths of the depressions range from between 100 micrometers to 4 millimeters; even more preferably, the heights of the projections and the depths of the depressions range from between 300 micrometers to 3 millimeters.

The Grip Enhancing Means may further comprise a plurality of spaced apart stripes or striped projections formed from a high friction material, such as a PVC material, for example. Preferably the stripes comprise raised or projecting stripes and are arranged to extend generally parallel to the axis of any existing finger stalls. Stripes and other forms may be uniformly spaced or spaced at varying intervals. Similarly, stripes and other forms may have varying thicknesses, heights or depths, depending on preference. The thickness ranges from about 100 micrometers to several millimeters; more preferably the thickness ranges from between 100 micrometers to 4 millimeters; even more preferably, the thickness ranges from between 300 micrometers to 3 millimeters. The Grip-Enhancing Means may create a pattern, may be in rows or randomly placed, and may form circular and non-circular shapes, such as spherical, cylindrical or elongated. Additionally, they may be individually separated or interconnected.

In general, a palmar surface of an embodiment can have a variety of finishes, one portion of the surface can have a smooth finish, for example, and another portion can have a textured surface. The textured portion could create a higher coefficient of friction, or grip enhancer, on the surface.

The Grip Enhancing Means can be formed on the glove by any standard method, for example, embossing, stamping or molding a portion of the glove to create the gripping means. For example, the Grip Enhancing Means can comprise regular projections of say, about 300 micrometers in height, but may vary in height depending on preference. The projections may all be the same height, and may be in rows. They may be embossed elongated shapes that are interconnected, thus creating a high coefficient of friction throughout the entire palmar surface area of the glove. Other embodiments could of course offer different heights, non-uniform heights, and have a more random pattern on the palmar portions forming the glove.

Alternatively, the Grip Enhancing Means may be attached, affixed or otherwise placed to select areas of the glove by standard methods and forms of attachment such as by overlaying a panel to select areas of the glove. This may be accomplished, for example, by creating a textured surface on a silicone-based layer and then hot melting said silicone surface onto the bottom surface of the most proximal end of the forefinger stall, thus providing a high friction surface on the embodiment. The Grip Enhancing Means may be affixed to the glove by any other standard methods of attachment, such as by stitching or adhesion.

The Grip Enhancing Means is located on the palmar portion of the glove. Within that parameter, preferably, the Grip Enhancing Means can be on any portion of any thumb stall or forefinger stall, any portion of the metacarpophalangeal joints, and any portion between the thumb stall and forefinger stall, generally defined by the forefinger metacarpal, the thumb metacarpal, and the glove segment between said metacarpals. The Grip Enhancing Means can therefore be specifically positioned to provide enhanced grip and a higher coefficient of friction along select areas than on the rest of the glove body. Of course, users may prefer any combination of the aforementioned. In at least one embodiment all of the above mentioned comprise of a Grip Enhancing Means including all of the metacarpals. In at least one embodiment, the palmar segment itself comprises a Grip Enhancing Means, thereby covering the entire palmar segment of the glove.

The Grip Enhancing Means will provide an effective coefficient of friction, preferably of at least a Shore A Durometer Coefficient of Friction of at least 1.0; more preferably, a Shore A Durometer Coefficient of Friction of at least 1.5; even more preferably, a Shore A Durometer Coefficient of Friction of between 2.0 and 4.5; still even more preferably, a Shore A Durometer Coefficient of Friction of between about 3.0 and 4.5.

The Grip Enhancing Means may also comprise of tackifiers, such as tackified leathers, tackified resins, tackified coatings and other tackifiers commonly known. These tackifiers will provide very high grip capabilities along the glove body, preferably of a Shore A Durometer Coefficient of Friction of between 2.5 and 4.5; even more preferably, a Shore A Durometer Coefficient of Friction of between about 3.0 and 4.5.

Tackifiers commonly known include 'X40 C-TACK™' Revolution manufactured by 'CUTTERS™', 'CARBON™' manufactured by 'NIKE™', and 'F3™' manufactured by 'UA™', for example.

Some embodiments, of course, will not have a Grip Enhancing Means on any part of the glove. These embodiments absent of any Grip Enhancing Means may have a Shock-Absorbing Member along the dorsal segment.

The Shock-Absorbing Member (or members) can comprise of any material that will provide added protection to a user's thumb, fingers, hand, wrist, or combinations thereof. In general, the Shock-Absorbing Member can comprise conventional materials for dissipating pressure across a surface area, can have varying densities and thicknesses, and can be in the form of a layer or multiple layers. Embodiments may comprise a Shock-Absorbing Member with or without a Grip Enhancing Means.

The Shock-Absorbing Member is flexible, compressible and/or resilient. The Shock-Absorbing Member can comprise of any foam or cotton-based fabrics, cloth paddings, such as a cushion, foams such as a polyurethane foam pad, and flexible plastics, and the like, to absorb impact received from opposing players or from hitting the ground. The Shock-Absorbing Member can comprise foam-filled segments, such as polyethylene foam pads or it can be of cotton or cloth, or encased gels. For example, the Shock-Absorbing Member may comprise of a unitary pad or pad segments, and may comprise any open cell or closed cell foam, such as 'BOLLARD™' foam, polyolefin foam and the like. The Shock-Absorbing Member may also be made of any common materials used in providing glove padding, including natural or synthetic rubber, natural or synthetic rubber foams, encased gels, polyester fiber, or cotton or other natural or synthetic wadding materials. Additionally, the Shock-Absorbing Member may possess a substantially uniform cell distribution or polyvinyl chloride foam plastic. The Shock-Absorbing Member may comprise of cushions or pads which can be implemented as any of a variety of conventional padding material, such as foam rubber of varying densities and thicknesses, layers of fabric of various types and thicknesses, conventional encased gel or plastic material, liquid-holding compartments, or other types of conventional materials. It will be apparent to one of ordinary skill in the art that many other implementations of pad construction are possible.

The Shock-Absorbing Member need not be very thick but can be, beginning from about 600 micrometers to about three inches. The thickness may vary according to location, such as finger versus metacarpal areas, and degree of desired protection. The thickness of similar embodiments may vary depending on several factors, such as for example, user preference. In other words, embodiments may be configured to absorb more or less by the thickness of the Shock-Absorbing Member. The embodiment can thus create a cushioning effect to, for example, protect an injury. Additionally, for example, quarterbacks who rarely rush with the football may only require a thinner pad, say 0.25 inch or less, as opposed to quarterbacks who more often need to run with the ball.

The Shock-Absorbing Member is primarily located on the dorsal portion of the glove. Within that parameter, preferably, the Shock-Absorbing Member can overlay any portion of any thumb and/or forefinger, and/or any portion of the five metacarpals. In at least one embodiment, the entire dorsal segment comprises a Shock-Absorbing Member, therefore mirroring the dorsal segment's design or structure of the glove.

Preferably, embodiments can also have a Shock-Absorbing Member along the dorsal surface overlaying the wrist area, provided a segment overlaying the wrist exists. The wrist segment off the glove may extend to overlay the carpals on the wrist area and be of substantial width length to cover a significant portion of the user's carpals, up to about five inches. The Shock-Absorbing Member overlaying the carpals on the wrist area may extend to also cover up to about five inches, and may do so as separate padding segments, for example, to allow for significant wrist flexibility, or may be configured as one pad.

The Shock-Absorbing Member can be constructed on the glove using standard techniques placing paddings on gloves, such as by stitching for example, or may alternatively be integrally formed on the glove. For example, the Shock-Absorbing Member may be encased in a compartment or compartments that are then attached to select areas of the glove. Alternatively, said member may be integrally formed on the glove and the Shock-Absorbing Member could be interposed in the glove with one compartment such as a liner, or within a plurality of discreet shock-absorbing protective compartments such as protrusions projecting out from the glove. The construction of these compartments may comprise of any flexible material, such as rubber, or may be of the same material forming the glove. Said compartment or compartments could house and allow said Shock-Absorbing Member to project out, for example, to provide protection in desired areas along generally the dorsal surface of the glove.

By way of example, if the Shock-Absorbing Member is placed onto the outer surface of the dorsal segment, it is envisioned that the pad could be sewn, bonded or otherwise attached atop the dorsal segment of the glove. A Shock-Absorbing Member may include an outer layer of material which encapsulates the pad and enables the outer periphery of the pad to be positioned without damaging the pad. For example, it is envisioned that the pad may include an outer layer made of the same material as the rest of the glove, or may be a heavier, thicker material, such as synthetic leather. The Shock-Absorbing Member, in this case a pad, is then inserted into the compartment. The encased pad can then be sewn, adhered to or otherwise secured on the glove, such as deposed adjacent the dorsal segment of the thumb stall.

The Shock-Absorbing Member may also be integrally formed on the glove. For example, the Shock-Absorbing Member may be located between the inner surface of the dorsal segment of the glove and a liner or sleeve. The liner (or sleeve) material would therefore be positioned between the Shock-Absorbing Member and a user's hand. The liner could be attached to the glove by standard methods, such as by conventional stitching about the perimeter of the dorsal segment, whereby the padded layer would be inserted and then sealed.

A similar method if the Shock-Absorbing Member is integrally formed from the sports glove comprises a flexible, preferably integrally molded dorsal member which has a tougher outer protective surface and a smooth hand contacting inner material, such as a liner or sleeve, being connected together around the peripheral edge of the molded member. The outer member may have a plurality of discrete shock-absorbing protective protrusions whereby the Shock-Absorbing Members could be housed. The protrusions may be in a variety of heights and shapes, and of sufficient dimensions to house each Shock-Absorbing Member.

The lining material (or sleeve) may be comprised of standard lining materials, such as a smooth, flexible knitted fabric. The liner may also comprise of flexible and elastomeric material such as spandex or 'LYCRA™'. Other possible materials include a knit of polyester or simply the same material forming the glove. A soft cellular plastic could also be preferred. Additionally, the liner may provide added features to offer warmth and comfort such as by comprising of a fleece material, for example, especially useful when competing in the rain or snow. It will be apparent to one of ordinary skill in the art that many other implementations of lining are possible.

These novel features will give a quarterback added protection from the abrasion from hitting his fingers against the helmet of an opponent, for example, or when wrapping his throwing hand around the football when rushing. The Shock-Absorbing Member sections of the present invention offer the unique ability of being able to protect an injury while maintaining grip capabilities in select areas by offering padded layer or layers, a significant and substantial advancement to prior art, such as bandages and 'BAND-AID™', thus providing a solution to a long-felt need of being able to protect a quarterback's throwing hand.

Some embodiments, of course, will not have a Shock-Absorbing Member on any part of the glove. These embodiments that are absent of any Shock-Absorbing Member will be useful and significantly beneficial to football quarterbacks but also especially to those playing the sport of golf, primarily because the unique finger configurations of the glove, as well as because of any Grip Enhancing Means on embodiments.

Embodiments may also comprise of a wrist securement opening means to secure the glove to the user's hand. The opening means may be, for example, an elastic means or a flap which mechanically engages a flap capture mechanism (e.g., a synthetic hook and loop fastening interface which adheres when pressed together, commonly using 'VELCRO™'). The wrist portion opening means may alternatively comprise an elastomeric band fixed around the wrist aperture. The wrist portion may be formed integral with the glove or may be attached to the glove by standard methods, such as by sewing. As aforementioned, said wrist segment may extend along the carpals of the user's arm.

The finger segments of embodiments would preferably be designed to fit snugly around a user's fingers, as are typical sports gloves. In addition, some embodiments may have material treated by a moisture repellant, for example 'SCOTCHGUARD™' or a synthetic resin, extremely useful during the Winter months, usually during the football playoffs. Additionally, embodiments may also comprise various weather-resistant and perspirant-resistant materials, forms and designs including, but not limited to, water-resistant materials or micro-recesses along any portion of the glove, for moisture management, or combinations thereof.

The present invention may be made and manufactured using standard materials and methods in developing sports gloves. Materials that could comprise these glove embodiments include, but are not limited to, woven materials such as natural, synthetic or blends of natural and synthetic yarns, thermoextruded or thermoset rubbery embodiments such as those made from thermoplastic elastomers. Examples of synthetic yarns include nylon, polyester, and spandex (polyurethane) yarns. Embodiments may also comprise stretch materials and designs, mesh fabrics, recycled and flexible materials, cottons, rayon, leathers and synthetic leathers, rubbers, plastics, woven fabrics, non-woven fabrics, cloths, 'LYCRA™', a vinyl material, a neoprene material, a fleece material, or combinations thereof.

The thickness of the dorsal and palmar segments can generally begin anywhere from 0.005 inches to 0.040 inches, for example, depending on several factors such as comfort and durability preferences. Some embodiments may offer more durable material for the dorsal surface thus requiring an even thicker dorsal segment. Of course, the more durable the material for more protection the glove may naturally provide. For example, embodiments may have a thinner palmar portion and/or of a more flexible material such as 'LYCRA™' for example whereas the dorsal portion may be thicker than the palmar portion and/or of a more durable material such as a synthetic leather for example, for protective purposes.

SUMMARY

As described herein, the present invention overcomes the limitations of the prior art in a number of significant ways. In general, embodiments of the present invention can generally be used in conjunction with any type of hand task activity and/or sports play. As discussed, embodiments offer an individual with the opportunity to increase overall hand task performance. Maintaining or increasing overall control, for example, can provide many benefits to a user of these, and other embodiments. These and other embodiments:

- offer the ability to grip as well as feel a ball, such as a football
- offer the ability to grip as well as feel a sports device, such as a golf club
- provide a unique solution for players who desire better grip capabilities in select areas
- offer basic benefits that standard gloves offer, now offered also to quarterbacks
- offer a more stabilizing overall grip of a ball or object, by conveying grip-enhancers to select locations of the hand
- provide grip enhancers along the connecting area between the thumb and forefinger
- allow an individual to maintain or increase control of a ball or object along the metacarpophalangeal joints
- permit the ability to use a glove on dominant hand configured to meet the unique needs of your preferred golf grip
- improve performance in hand task execution
- improve stability of overall grip throughout the hands
- offer more control capabilities throughout a sports task, a valuable feature when striking a golf club with greater velocity
- afford more control throughout a football task, such as when throwing a slippery football or when under duress
- allow more hand coordination by adjusting enhancers to match one particular golf swing
- make for less football mishandles
- create more safety in playing the position of quarterback especially for the youth in our country
- finally give quarterbacks the necessary protection already offered to others who rush with the football, such as running backs These are among the many benefits of the present invention, and are not to be construed as limitations of the benefits nor their legal equivalent.

Although the description of the present invention only discussed two sports, it is understood that individuals playing other sports might benefit as well, such as baseball, volleyball and basketball. Additionally, although embodiments have generally been discussed for a particular sport, it is only by way of example. In other words, the embodiments discussed related to football may also easily be used in golf, and vice versa. In addition, the term 'overlay' is not meant to limit how the Grip Enhancing Means or the Shock-Absorbing Member will be created on embodiments of the present invention. Indeed, as has been demonstrated, the Grip Enhancing Means and Shock-Absorbing Member may be integrally formed of many of these embodiments. Therefore, use of the term 'overlay' may be defined more broadly, as "applied, affixed, formed on or otherwise created on."

In addition, only some embodiments have been discussed and in no way is intended to limit all the various embodiments and other embodiments that the present invention provides, such as but not limited to, different designs. Embodiments can of course be used by men and women, boys and girls, professional athletes or amateurs, as well as for those whose dominant hand is the right hand or the left.

BRIEF DESCRIPTIONS OF THE DRAWING

It is expressly understood that the following descriptions and drawing are for illustration purposes only, and in no way are intended to limit the scope of the present invention and its various embodiments. For example, the drawings are of embodiments for the left hand but can easily be created for the right hand.

FIG. 1 is a drawing of the palmar (front) view of an embodiment. The thumb and forefinger are completely covered. The ring finger and pinkie finger are essentially completely uncovered. The middle finger is also completely uncovered. Provided on the palmar portion of the glove is a Grip Enhancing Means, both integrally formed and formed on a panel.

FIG. 2 is a drawing of the embodiment as described in FIG. 1, showing the dorsal (back) view. Provided on the dorsal portion is a Shock-Absorbing Member.

FIG. 3 is a drawing of the palmar view of a second embodiment. The thumb and forefinger are completely covered. The ring finger and pinkie finger are essentially completely uncovered. The middle finger is also completely uncovered. Provided on the palmar portion is a Grip Enhancing Means.

FIG. 4 is a drawing of the embodiment as described in FIG. 3, showing the dorsal view. Provided on the dorsal portion of the glove is a Shock-Absorbing Member.

FIG. 5 is a drawing of the palmar view of a third embodiment, shown as a partial-fingered glove. The thumb and forefinger are completely covered. The ring finger and pinkie finger are essentially completely uncovered. The middle finger is also completely uncovered. Provided on the palmar portion of the glove is a Grip Enhancing Means.

DETAILED DESCRIPTION OF THE DRAWINGS

It is expressly understood that the drawings are for the purpose of illustration and description only and are not intended as a definition of the limits of the invention.

Figure 1:
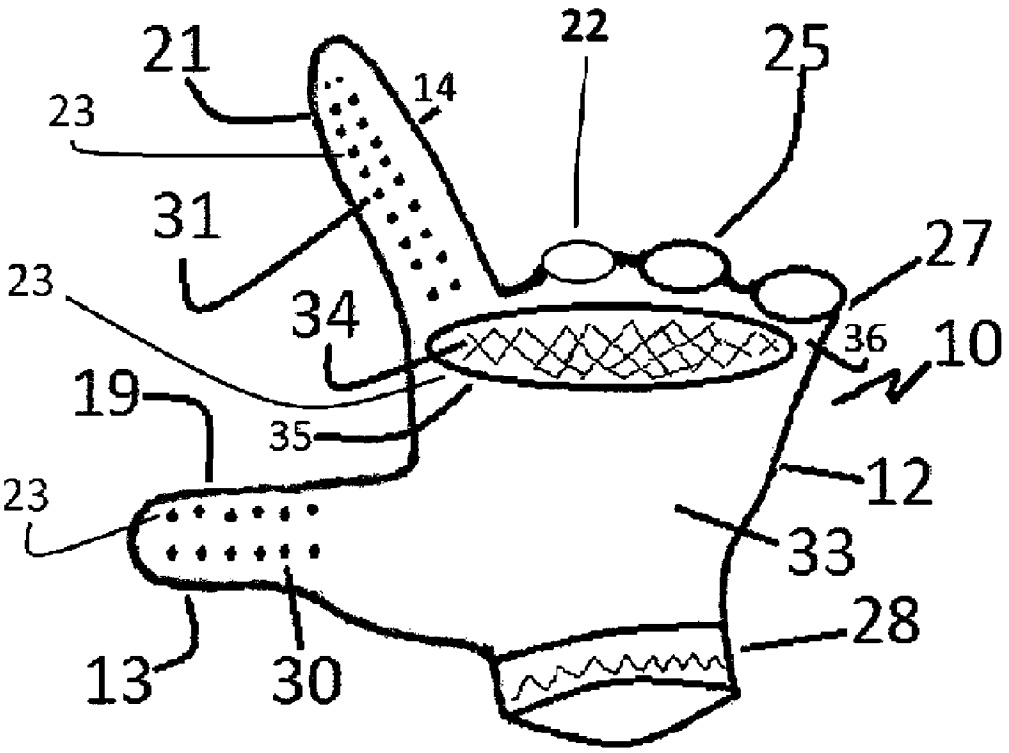
Figure 2:
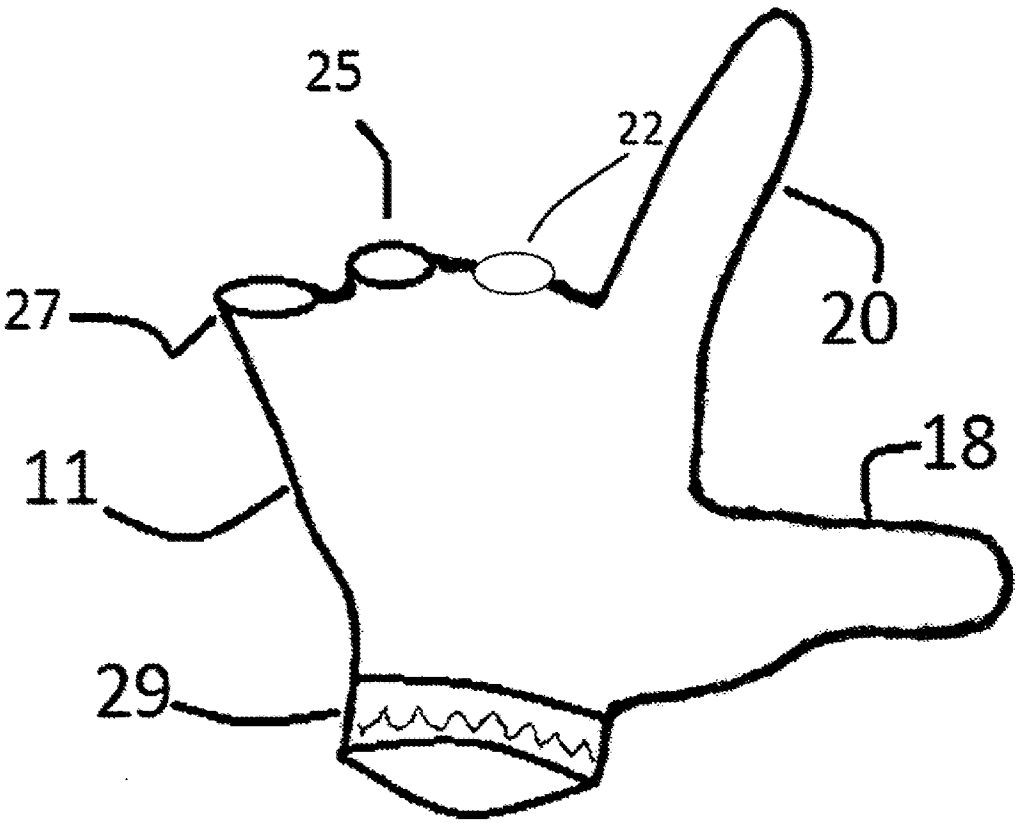

Referring now to FIG. 1 and FIG. 2, an athletic glove of the present invention is shown and designated as 10. The palmar (front) view of a left-handed glove is drawn in FIG. 1 and the dorsal (back) view of the same glove is drawn in FIG. 2. This partial-fingered embodiment provides a glove having a dorsal portion 11, a palmar portion 12 for overlaying respective back and palm regions of a human hand, said dorsal and palmar portions having distal and proximal ends with a plurality of digital segments (or stalls) projecting from said distal ends. Additionally, three separate openings or ringlets are provided on said distal ends, such that a user's ring finger, pinkie finger and middle finger may individually extend through said glove.

The glove includes a glove body having a back portion covering the back of the hand 11, and a front portion covering substantially all of the palm or front of the hand 12. The glove body includes a forefinger stall and a thumb stall each adapted to receive a forefinger or thumb, respectively, therein.

In the illustrated embodiment, the glove is constructed such that the thumb 13 and forefinger 14 digital segments enclose said thumb and forefinger, including enclosing the fingertips. The glove does not comprise of finger stalls for a user's middle finger, ring finger or pinkie finger. Therefore, the middle finger, ring finger and pinkie finger are all completely uncovered.

The distal ends of the dorsal portion 11 and palmar portion 12 of the glove body further provides three separate finger openings (or ringlets) 22, 25, 27, where a user's middle finger, ring finger and pinkie finger may extend through said glove body and thereby being completely uncovered by said glove body.

The palmar section covers the entire palm of the hand 12; the dorsal section covers most of the back of the hand 11, allowing only for any micro recesses along the dorsal surface, typically used to provide ventilation. The glove also has a wrist portion that surrounds the wrist of a user.

The thumb stall 13 is defined by a dorsal portion 18 and a palmar portion 19. The forefinger stall 14 is defined by a dorsal portion 20 and a palmar portion 21. An opening (or ringlet) is provided for the middle finger 22. An opening (or ringlet) is provided for the ring finger 25. An opening (or ringlet) is provided for the pinkie finger 27. The wrist portion is preferably expansible so as to hold more securely to the user's wrist. Therefore the embodiment also has an expandable opening means 28 at a wrist end 29 adapted to receive the user's hand. The expandable opening means comprises an elastic material along the wrist portion, such as an elastomeric band 28 fixed around the wrist. If desired, the opening means may comprise a strap means at the open end of the glove body for fastening the glove body secure about the wrist area. The strap means may be unitary with the glove body and may include 'VELCRO™' fasteners, buttons, and the like or other suitable closure means thereon.

This embodiment further shows how the present invention may comprise a Grip Enhancing Means 23. Although the glove now provides a higher coefficient of friction on the throwing hand of a quarterback or on a golfer's dominant hand, one may now further increase grip capabilities by adding a Grip Enhancing Means along the palmar surface of the glove.

Provided on the palmar portion 12 of this embodiment is a Grip Enhancing Means 23. The Grip Enhancing Means, as aforementioned, may be in the form of PVC dots, for example, and located on the thumb and forefinger segments. The PVC dots preferably project out at least about seven hundred micrometers. The PVC dots located on the palmar section of the thumb 30 and forefinger stalls 31 are throughout said stalls. Similar embodiments may have a Grip Enhancing Means along only the thumb segment overlaying the distal phalanx or the forefinger's distal phalanx, or combinations thereof, to maximize grip abilities on the fingertips of the thumb and forefinger.

The Grip Enhancing Means 23 may be integral to the glove or may be affixed to the glove using any standard methods. For example, this embodiment comprises Grip Enhancing Means that are integral to the glove thumb and forefinger stalls, using any standard method known in the art. For example, the PVC dots can be imparted by any standard methods, such as, for example, by molding. The heights of the PVC dots in this embodiment are all the same height, and are in rows. Other embodiments could of course offer different heights, non-uniform heights, and have a more random pattern on the top surface.

The locations of the Grip Enhancing Means may vary on several factors of course, such as personal preference and preferred degree of enhanced grip. This added grip configuration will be useful to quarterbacks and golfers for reasons described herein. Other grip enhancing configurations and locations may of course be preferred.

Figure 3:
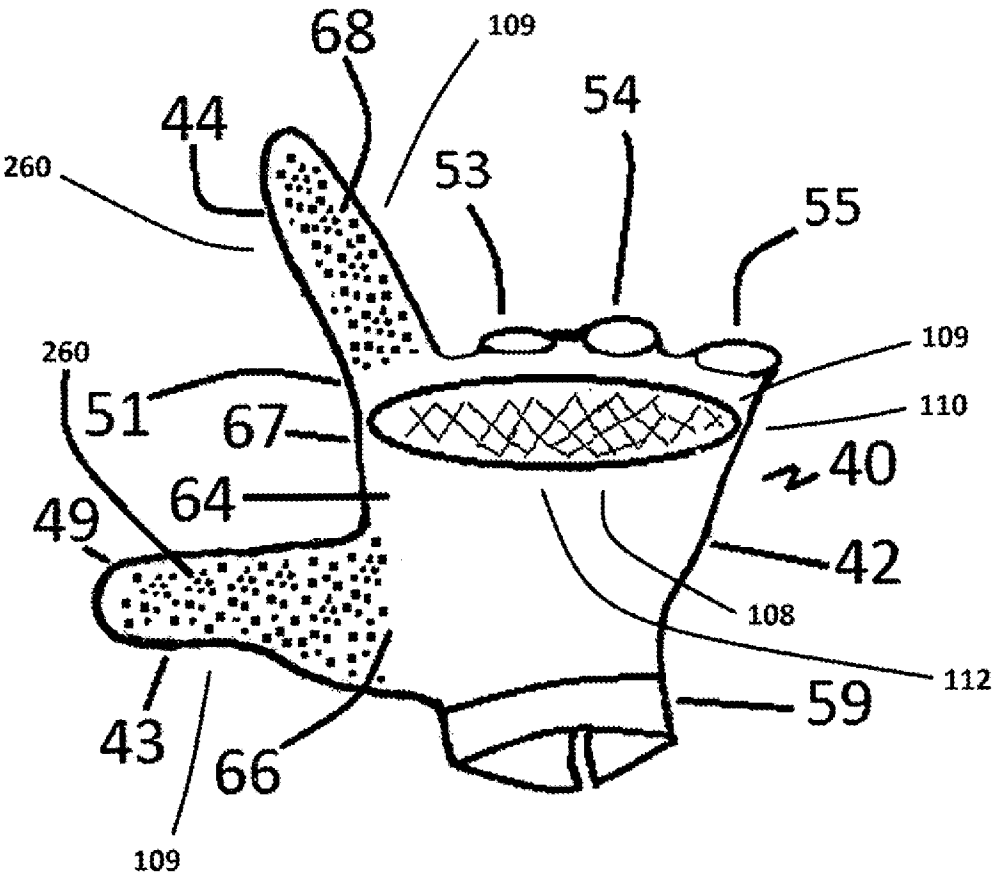

For example, a quarterback who often rushes with the football may prefer a grip enhancer throughout any existing finger stalls, whereas a quarterback who often throws the football may prefer a Grip Enhancing Means on the fingertips of the thumb and forefinger segments, and along the area between the thumb and forefinger metacarpophalangeal joints (See FIG. 3). Having a Grip Enhancing Means along these areas will significantly increase the quarterback's ability to control the football throughout a throw or rush attempt by creating an even higher coefficient of friction than what the skin of a user would otherwise provide.

A golfer may have similar grip enhancing preferences as those discussed. An individual using the interlocking grip method may additionally desire a Grip Enhancing Means overlaying the palmar surface area of the pinkie finger's metacarpophalangeal joint, in part or in its entirety. The resulting grip enhancing configurations would offer the golfer added control on the dominant hand's thumb, forefinger, and along the area where the golfer's two hands interlock. Additionally, the partially uncovered fingers would offer maximum retention of tactile sensation along uncovered finger portions. This unique offering will significantly increase the golfer's ability to control a golf club and also therefore a golf swing.

The embodiment's Grip Enhancing Means 23 can also comprise of a high friction surface, such as depressions 34, creating crisscross depressions 34 for example, to the glove area beginning at the digital creases and extending to overlay the forefinger metacarpophalangeal joint; the middle finger metacarpophalangeal joint, the ring finger metacarpophalangeal joint, and the pinkie finger metacarpophalangeal joint, 34. The Grip Enhancing Means portion overlaying the pinkie finger metacarpophalangeal joint preferably does not extend over the upper-palmar crease, however, to provide optimal flexibility.

The Grip Enhancing Means can also comprise of a high friction surface by applying a non-slip coating, such as a latex, nitrile, or PVC coating, along described locations of this embodiment. The coating could of course also be applied to the entire palmar portion of the glove.

A plurality of tiny recesses of about 0.120 millimeters in diameter may be randomly disposed about the front, back and finger and thumb stalls of the glove, thereby providing added comfort and more ventilation.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example.

This embodiment further shows how the present invention may comprise of the same materials to construct both the palmar and dorsal surface. This particular glove can be made of a polyester and cotton blend for superior comfort, say about seventy percent polyester, for example. The polyester thread, for example, could be spun with the cotton yarns to produce the composite. Other materials that could comprise these glove embodiments include, but are not limited to woven materials that include natural, synthetic or blends of natural and synthetic yarns, flexible plastics, and thermoextruded or thermoset rubbery embodiments including those made from thermoplastic elastomers. Examples of synthetic yarns include nylon, polyester, and spandex (polyurethane) yarns, and 'LYCRA™'. Additionally, embodiments such as this one may be completely coated with a water repellant substance 33, such as a synthetic resin 33.

This embodiment also may comprise a Grip Enhancing Means that is affixed to the glove. In general, as aforementioned, a Grip Enhancing Means may be either formed on or applied to any palmar portion, such as the palm or any thumb or any existing finger stalls for example, using any standard methods. The embodiment's gripping means can comprise of a high friction surface, such as depressions 34, creating crisscross grooves 34 that are depressed onto a rubber surface panel 35, for example, then attaching said panel onto a portion of the glove palmar surface area. The panel is then attached to the palmar surface of the glove by any standard methods of attachment, such as by adhesion or stitching.

The panel may be is attached to the glove area, for example, beginning at the digital creases and extending to overlay the forefinger metacarpophalangeal joint, the middle finger metacarpophalangeal joint, the ring finger metacarpophalangeal joint, and the pinkie finger metacarpophalangeal joint, 34. The panel portion overlaying the pinkie finger metacarpophalangeal 36 preferably does not extend over the upper-palmar crease, however, to provide optimal flexibility. This form of attachment may additionally be used to affix a Grip Enhancing Means over the thumb stall, any existing finger stalls and/or along the area between the forefinger and thumb stalls, in part or in their entirety, for example.

The panel may generally be comprised of any flexible material, for example, a plastic material 35 having a top surface comprising the grip enhancing area formed by a plurality of depressions 34 such as, for example, ridges. A preferred depth of the depressions would be such that the gap formed by the depressions would allow for some movement of the newly formed top surface edges thereby increasing the grip capabilities of the user. This grip enhancer could have a preferred depth beginning about six hundred micrometers, and can be imparted by, for example, embossing or standard mechanical treatments. The grip enhancing surface would provide an effective coefficient of friction, preferably of at least a Shore A Durometer of three or greater. The panel would then be bonded to, and become a part of the top surface of a portion of the glove, by any standard method such as, for example, cementing or hot melt gluing.

Figure 4:
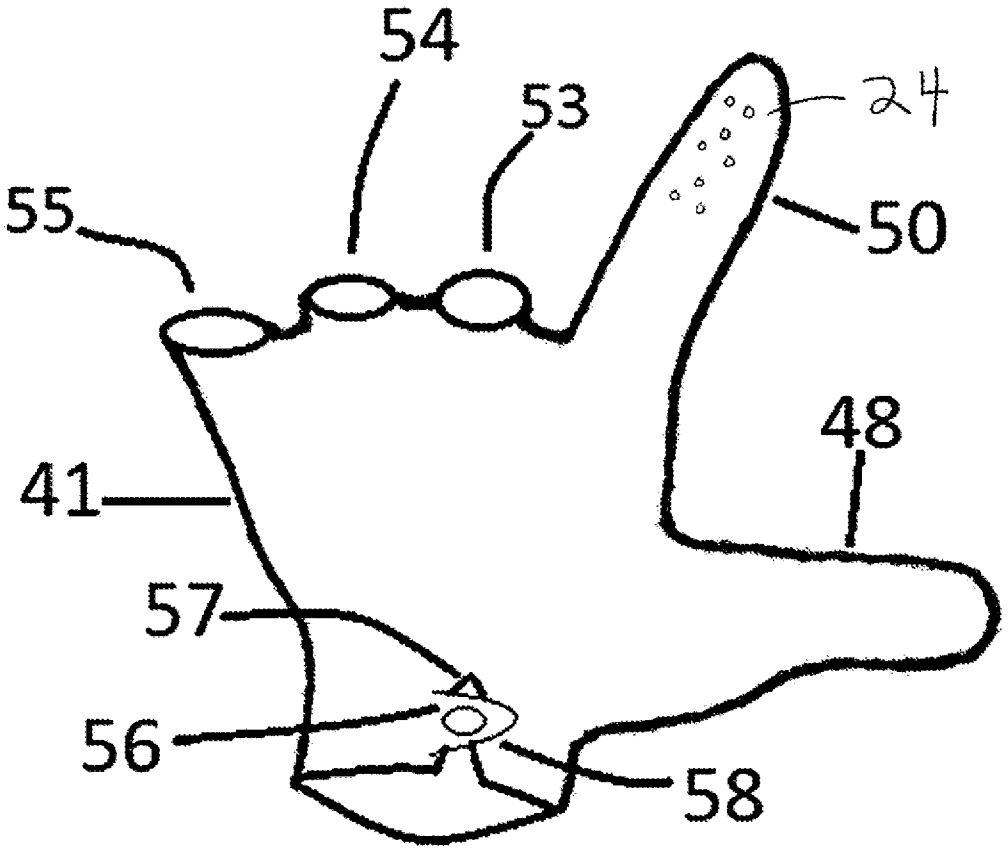

Referring now to FIG. 3 and FIG. 4, a second embodiment of the athletic glove of the present invention is shown and designated as 40. The palmar (front) view of a left-handed glove is drawn in FIG. 3 and the dorsal (back) view of the same glove is drawn in FIG. 4. This partial-fingered embodiment provides a glove having a dorsal portion 41 and a palmar portion 42 for overlaying respective back and palm regions of a human hand, said dorsal and palmar portions having distal and proximal ends with a plurality of digital segments (or stalls) projecting from said distal ends. The glove includes a glove body having a back portion covering essentially the entire dorsal surface of the hand 41, and a front portion covering essentially the entire palm surface of the hand 42. The glove body includes a finger segment and a thumb segment each adapted to receive a finger and thumb, respectively, therein. Additionally, three separate openings or ringlets are provided on said distal ends, such that a user's ring finger, pinkie finger and middle finger may individually extend through said glove.

The glove is constructed such that the thumb 43 and forefinger 44 digital segments completely enclose said thumb and forefinger, including enclosing the fingertips. The middle finger, ring finger and pinkie finger are all completely uncovered.

The glove does not comprise of finger stalls for a user's middle finger, ring finger or pinkie finger. Therefore, the middle finger, ring finger and pinkie finger are all completely uncovered.

The distal ends of the dorsal portion 41 and palmar portion 42 of the glove body further provides three separate finger openings/ringlets/recesses 53, 54, 55, where a user's middle finger, ring finger and pinkie finger may extend through said glove body and thereby being completely uncovered by said glove body.

The palmar surface of the glove essentially covers the rest of the front of the hand, including the entire palm of the hand 42; the dorsal section covers most of the back of the hand 41, allowing only for micro recesses for ventilation 24, and for a slit on the wrist portion for an opening to more easily insert a hand. The thumb stall 43 is defined by a dorsal portion 48 and palmar portion 49. The forefinger stall 44 is defined by a dorsal portion 50 and a palmar portion 51. A separate opening is provided for the middle finger 53, the ring finger 54, and the pinkie finger 55.

The glove also has an expandable opening means at a wrist end portion 59 adapted to receive the user's hand. The expandable opening means comprises a strap means 56 at the open end 57 of the glove body for fastening the glove body secure about the wrist area. The strap means may be unitary with the glove body and may include 'VELCRO™' fasteners 58, buttons, and the like or other suitable closure means thereon. The wrist portion is preferably expansible so as to hold more securely around the user's wrist. The dorsal surface of the glove therefore has an uncovered portion along the wrist area 57. As with other embodiments, this glove may alternatively have an expandable opening means comprised of an elastic material to expand and contract for easier glove application onto a hand, as previously described.

This embodiment further shows how the present invention may comprise a Grip Enhancing Means 109. Although the embodiment now provides a higher coefficient of friction on the throwing hand of a quarterback or on a golfer's dominant hand, one may now further increase grip areas by adding a Grip Enhancing Means on select areas.

The illustrated embodiment has a Grip Enhancing Means on select areas of the front of the hand, specifically along the two digital segments as well as along the region between the thumb and forefinger segments. The Grip Enhancing Means comprises a tackifier material 260, configured to provide a high coefficient of friction, preferably a Shore A Durometer Coefficient of Friction of at least 2.5; more preferably a Shore A Durometer Coefficient of Friction of between 2.5 and 4.5.

The tackifier located on the palmar section of the thumb stall 49 and forefinger stall 51 are throughout said stalls. Similar embodiments may have a Grip Enhancing Means along only the distal phalanx of the thumb segment or the distal phalanx of the forefinger, or combinations thereof, to maximize grip abilities primarily on the fingertips of the thumb and forefinger.

The Grip Enhancing Means may also be provided on the palmar portion of the glove overlaying the area between the thumb and the forefinger segments 64, generally defined by the portion overlaying the forefinger metacarpal, the thumb metacarpal 66 and the area between said metacarpals extending to the edge of the palm 67. The Grip Enhancing Means can also comprise of a high friction surface by applying a non-slip panel, such as a latex, nitrile or PVC coating, along described locations of this embodiment 49, 51, 64. The coating could of course also be applied to the entire palmar portion of the glove 42.

The locations of the Grip Enhancing Means may vary on several factors of course, such as personal preference and preferred degree of enhanced grip.

As discussed, the Grip Enhancing Means may be integral to the glove or may be affixed to the glove using any standard methods. For example, this embodiment can comprise Grip Enhancing Means that are integral to the glove, using any standard method to accomplish this, such as constructing the palmar portion of the glove body thumb stall 49 and forefinger stall 51 using a tackified leather by any standard method, and then attaching said palmar portion to the rest of the palmar glove body by any standard methods, such as by sewing. Finally, the entire palmar segment may be conjoined to the dorsal segment thereby creating said glove. As mentioned, the Grip Enhancing Means can also comprise of a high friction surface by applying a non-slip coating, such as latex, nitrile or PVC coating. These coatings may be a preferable choice when applying a Grip Enhancing Means on any metacarpophalangeal joints. This would be especially useful for golfers using the interlocking grip or football quarterbacks, for example, by providing added grip along critical grip areas.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example. One could use any standard method of manufacture and assembly or construction known in the art.

The embodiment's Grip Enhancing Means 109 can also comprise of a high friction surface, such as projections 108, creating crisscross projections 108 for example, to the glove area beginning at the digital creases and extending to overlay the forefinger metacarpophalangeal joint; the middle finger metacarpophalangeal joint, the ring finger metacarpophalangeal joint, and the pinkie finger metacarpophalangeal joint, 112. The Grip Enhancing Means portion overlaying the pinkie finger metacarpophalangeal joint 110 preferably does not extend over the upper-palmar crease, however, to provide optimal flexibility.

The Grip Enhancing Means can also comprise of a high friction surface by applying a non-slip coating, such as a latex, nitrile, or PVC coating, along described locations of this embodiment. The coating could of course also be applied to the entire palmar portion of the glove.

This embodiment also may comprise a Grip Enhancing Means 109 that is affixed to the glove. In general, as aforementioned, a Grip Enhancing Means may be either formed on or applied to any palmar portion, such as the palm or any thumb or any existing finger stalls for example, using any standard methods. The embodiment's gripping means can comprise of a high friction surface, such as a plurality of projections 108, creating crisscrosses 108 that are formed onto a panel 112, such as a neoprene surface panel 112, for example, then attaching said panel onto a portion of the glove palmar surface area. The panel is then attached to the palmar surface of the glove by any standard methods of attachment, such as by adhesion or stitching.

The panel may be is attached to the glove area, for example, beginning at the digital creases and extending to overlay the forefinger metacarpophalangeal joint, the middle finger metacarpophalangeal joint, the ring finger metacarpophalangeal joint, and the pinkie finger metacarpophalangeal joint, 112. The panel portion overlaying the pinkie finger metacarpophalangeal 110 preferably does not extend over the upper-palmar crease, however, to provide optimal flexibility. This form of attachment may additionally be used to affix a Grip Enhancing Means over the thumb stall, any existing finger stalls and/or along the area between the forefinger and thumb stalls, in part or in their entirety, for example.

The panel 112 may generally be comprised of any flexible material, for example, a plastic material, a neoprene material, or a plastic material having a top surface comprising the grip enhancing area formed by a plurality of projections 108 such as, for example, projected ridges or circular dots. A preferred heights of the projections would be such that the gap formed by the projections would allow for some movement of the newly formed top surface edges thereby increasing the grip capabilities of the user. This grip enhancer could have a preferred heights beginning about three hundred micrometers, and can be imparted by, for example, embossing or standard mechanical treatments. The grip enhancing panel surface preferably also comprises a tackifier material 112 configured to provide an effective coefficient of friction, preferably of at least a Shore A Durometer Coefficient of Friction of between 2.5 and 4.5. The panel would then be bonded to, and become a part of the top surface of a portion of the glove, by any standard method such as, for example, cementing or hot melt gluing.

The embodiment is suitably a substantially conventionally constructed sports glove, modified as aforementioned. This particular glove can be made of a thinner more flexible material forming the palmar segment (absent the thumb and forefinger stall formed by a tackified leather) such as polyester and cotton blend 42 for superior comfort and a more thicker synthetic leather forming the dorsal segment 41 for added durability. In other words, the glove formed provides a dorsal segment that is thicker than the palmar segment. Other materials that could comprise these glove embodiments include, but are not limited to woven materials that include natural, synthetic or blends of natural and synthetic yarns, thermoextruded or thermoset rubbery embodiments including those made from thermoplastic elastomers, and cloths.

Examples of synthetic yarns include nylon, polyester, and spandex (polyurethane) yarns. Additionally, embodiments such as this one may be coated with a with a water repellant substance, such as a synthetic resin throughout the glove 40.

Figure 5:
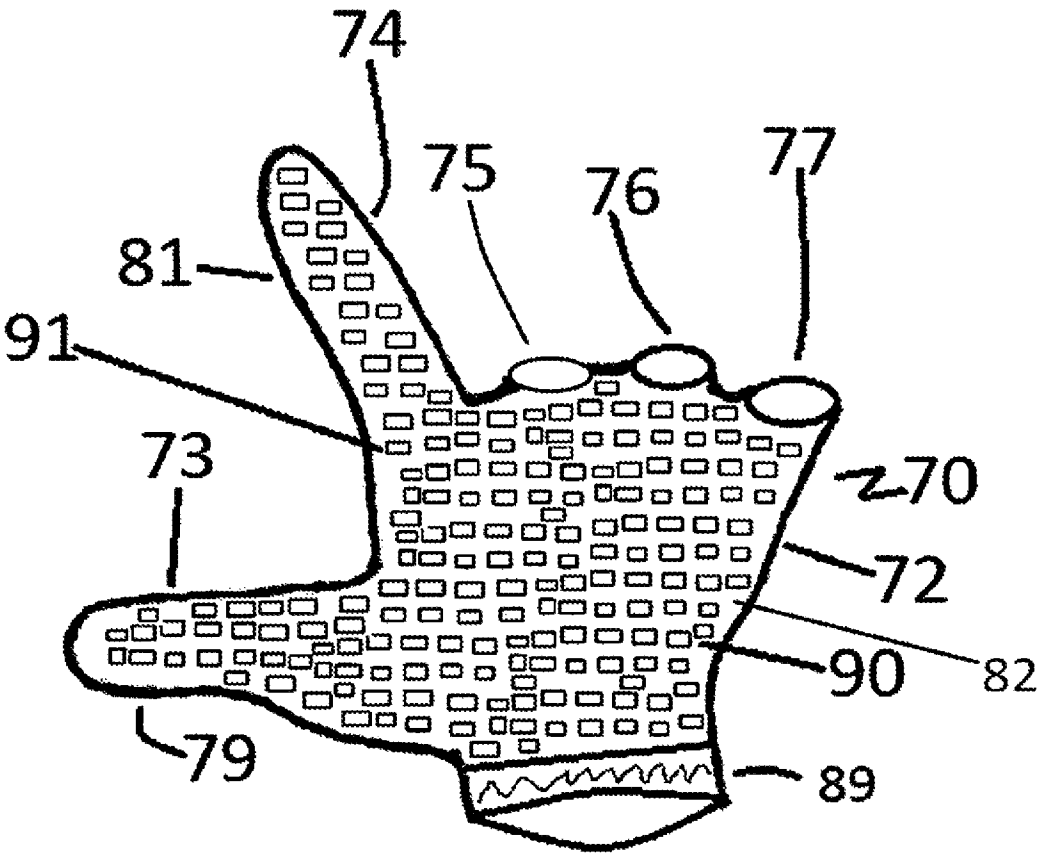
Figure 6:
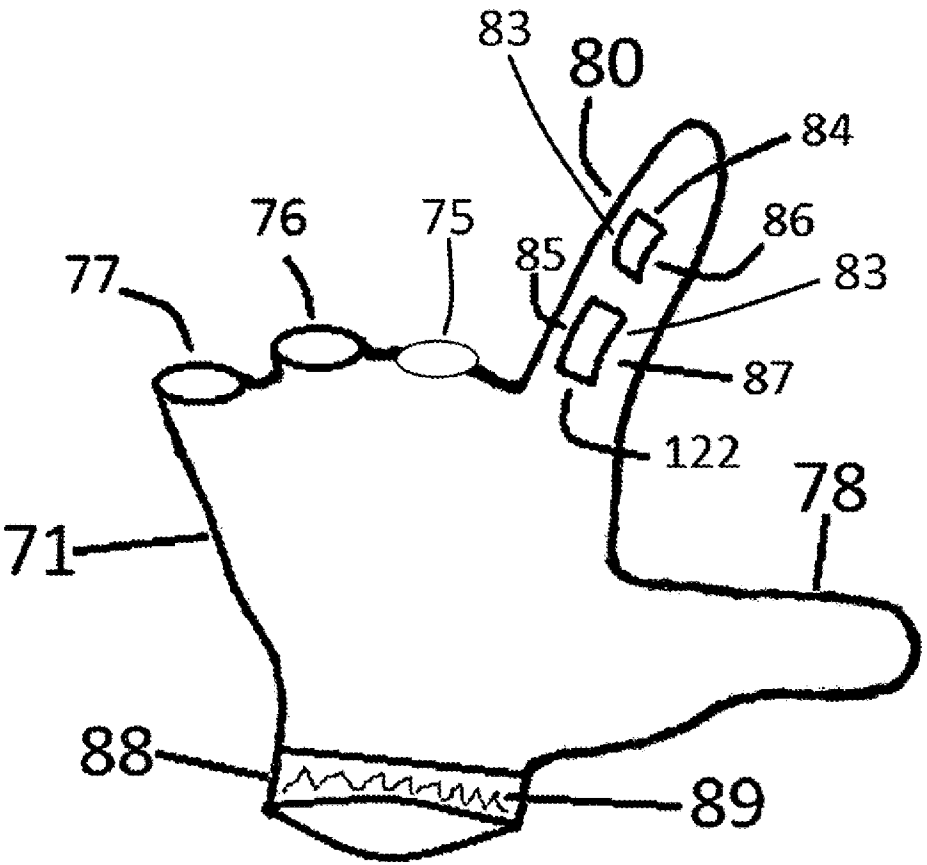
FIG. 6 is a drawing of the embodiment as described in FIG. 5, showing the dorsal view. Provided on the dorsal portion of the glove is a Shock-Absorbing Member.

Referring now to FIG. 5 and FIG. 6, a third embodiment of the present invention is shown and designated as 70. The palmar view of a left-handed glove is drawn in FIG. 5 and the dorsal view of the same glove is drawn in FIG. 6. This partial-fingered embodiment provides a glove having a dorsal portion 71, a palmar portion 72 for overlaying respective back and palm regions of a human hand, said dorsal and palmar portions having distal and proximal ends with a plurality of digital segments (or stalls) projecting from said distal ends. The glove includes a glove body having a back portion covering the back of the hand 71, and a front portion covering the palm or front of the hand 72. The glove body includes a forefinger stall (or digital segment) and a thumb stall (digital segment) each adapted to receive a forefinger and a thumb, respectively, therein.

The glove does not comprise of finger stalls for a user's middle finger, ring finger or pinkie finger. Therefore, the middle finger, ring finger and pinkie finger are all completely uncovered.

The distal ends of the dorsal portion 71 and palmar portion 72 of the glove body further provides three separate finger openings (or ringlets) 75, 76, 77, where a user's middle finger, ring finger and pinkie finger may extend through said glove body and thereby being completely uncovered by said glove body.

In the illustrated embodiment, the glove is constructed such that the thumb 73 and forefinger 74 digital segments enclose said thumb and forefinger, including enclosing the fingertips. The glove does not have a middle finger stall, a ring finger stall or a pinkie finger stall. Therefore, the middle finger, ring finger and pinkie finger are all essentially completely uncovered.

The palmar section covers the palm of the hand 72; the dorsal section covers the back of the hand 71. The glove also has a wrist portion that surrounds the wrist of a user.

The thumb stall 73 is defined by a dorsal portion 78 and a palmar portion 79. The forefinger stall 74 is defined by a dorsal portion 80 and a palmar portion 81. The middle finger stall 75 is defined by a dorsal portion 82 and a palmar portion 83. An separate opening is provided for the middle finger 75, the ring finger 76, and the pinkie finger 77. The wrist portion is preferably expansible so as to hold more securely to the user's wrist. Therefore the embodiment also has an expandable opening means 88 at a wrist end 89 adapted to receive the user's hand. The expandable opening means comprises an elastic material along the wrist portion, such as an elastomeric band 88 fixed around the wrist. If desired, the opening means may comprise a strap means at the open end of the glove body for fastening the glove body secure about the wrist area. The strap may have two pads of cohesive-adhesive material for releasably securing the strap. The strap as well as the wrist portion may be sewn onto the glove.

This embodiment further shows how the present invention may comprise a Grip Enhancing Means 82. Although the embodiment now provides a higher coefficient of friction on the throwing hand of a quarterback or on a golfer's dominant hand, one may now further increase grip areas by adding a Grip Enhancing Means on select areas or on the entire palmar surface of the glove.

In the illustrated embodiment, the Grip Enhancing Means comprises a high friction surface 90 formed on the entire palmar surface of the glove 72, including the palmar surfaces of the thumb segment 79 and on any palmar portion of the existing forefinger segment 81. Preferably, the high friction surface is formed from a PVC material, a latex material, or a rubber material. The surface may include a depression or projection pattern formed from the high friction material. Formed on this material is a plurality of projections 91 that are applied to the entire palmar surface area by any standard mechanisms. These square-like projections preferably are spaced apart to allow for added grip and flexibility. The rubber palmar surface can then be conjoined to the dorsal surface, for example, thus creating the glove.

The dorsal surface may comprise of a different material than the palmar surface, such as a more durable fabric, but would preferably also be rather flexible. If the dorsal surface is comprised of more durable fabrics, such as synthetic leather, then some added elasticity capabilities may be also preferable, though not required, on select area of the dorsal surface, in particular around the metacarpophalangeal joints. For example, the dorsal surface may comprise of an aperture on the forefinger's metacarpophalangeal joint, the middle finger's metacarpophalangeal joint, the ring finger's metacarpophalangeal joint, and on the pinkie finger's metacarpophalangeal joint (as seen 93 and 94 on FIG. 12). Alternatively, embodiments may simply comprise of a more elastic material of the dorsal surface overlaying said metacarpophalangeal joints while the rest of the dorsal surface is comprised of a more durable material. Additionally, said joints may simply have protrusions molded into the dorsal surface thereby allowing added flexibility along select areas of the hand (as seen 166 on FIG. 11).

Embodiments may also preferably comprise of a Shock-Absorbing Member 83 (or members) along any portion of the dorsal surface, such as any or all existing finger or thumb stalls, along the dorsal surface overlaying any or all of the metacarpals, along any of the carpometacarpal joints, or combinations thereof. In at least one embodiment a Shock-Absorbing Member is secured along substantially the entire dorsal segment. The Shock-Absorbing Member would then essentially mirror the dorsal surface design, and can be configured as a one pad segment. Other embodiments may preferably cover the dorsal segment as separate padding segments, for example, to allow for significant finger flexibility by having one pad overlaying only the proximal phalanges, a second pad overlaying only the distal phalanges, and a third pad overlaying the metacarpals of any existing finger segments. A separate pad segment may also overlay the wrist portion, such as a crescent shaped pad surrounding the metacarpalcarpal joints or the carpal bone, in part or in their entirety.

The illustrated embodiment has Shock-Absorbing Members along substantially the dorsal surface overlaying the forefinger 80. The Shock-Absorbing Member overlaying only the forefinger's proximal phalanx is in the pattern of a rectangle 85, and is configured as a one pad segment 87. The Shock-Absorbing Member overlaying the forefinger's proximal interphalangeal joint area is in the pattern of a square 84, and is configured as a one pad segment 86. Other embodiments may prefer to combine the entire area as one padding segment, for example, to allow for added protection throughout the forefinger.

As mentioned, the Shock-Absorbing Member may be affixed to the glove by any standard methods of attachment, such as by stitching or adhesion. For example, it can be in the form of pouches 122 or attachments to the glove, said pouches containing the padding, and then bonding said pouches to the back of the glove, using heat sealing or other standard methods.

The pouches may be constructed using standard material, such as flexible rubber or plastics, or made of the same material forming the dorsal surface of the glove.

The Shock-Absorbing Members may alternatively be integral with the material that form the glove, and may be applied to the glove by standard methods and forms of attachment methods as aforementioned.

The thickness of the padding in this embodiment may vary, beginning at about ¼ inch or more, and made of any material aforementioned. The length of the embodiment Shock-Absorbing Members are generally restricted to the length of the forefinger segment extending from the glove and, as mentioned, the dorsal surface area of the forefinger segment—allowing for the Shock-Absorbing Member to extend circumferentially along the sides of the forefinger segment but not extending onto the palmar surface of the forefinger segment.

The palmar and dorsal surfaces, and any wrist portions, may be joined together using any standard methods, such as by stitching, thus defining a pocket for receiving a user's hand.

Figure 7:
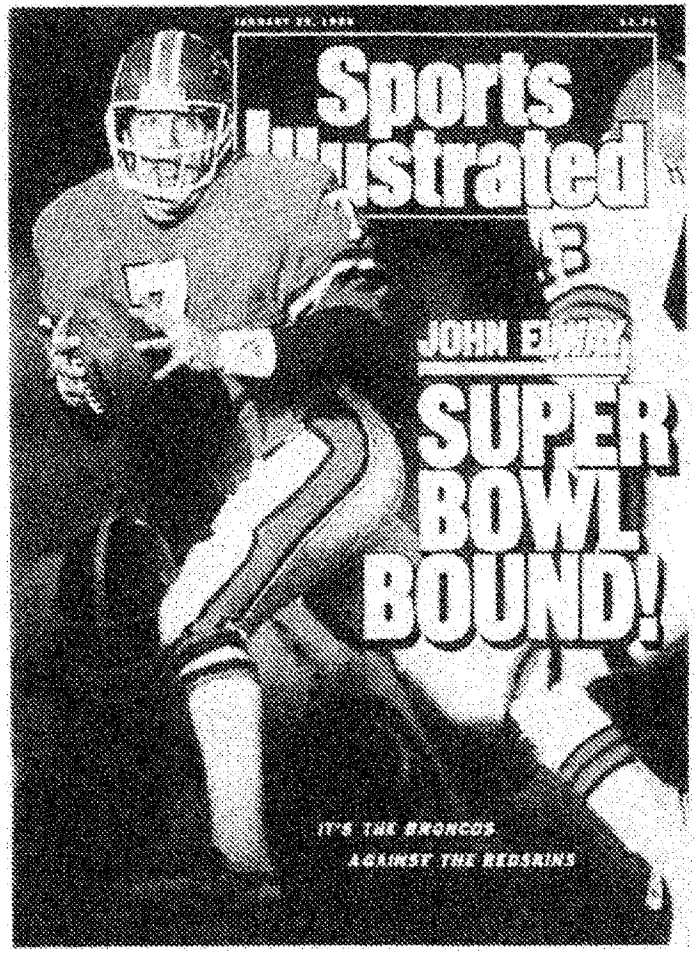
FIG. 7 is a picture of a famous football quarterback's football grip.

Referring now to FIG. 7 is a picture of John Elway's hall of fame football grip and captures a standard method of preparing to throw a football. As one can see, Elway's glove-less throwing hand has his middle finger and ring finger overlaying the football laces, while his thumb, forefinger and pinkie fingers are holding the football as best they can.

Figure 8:
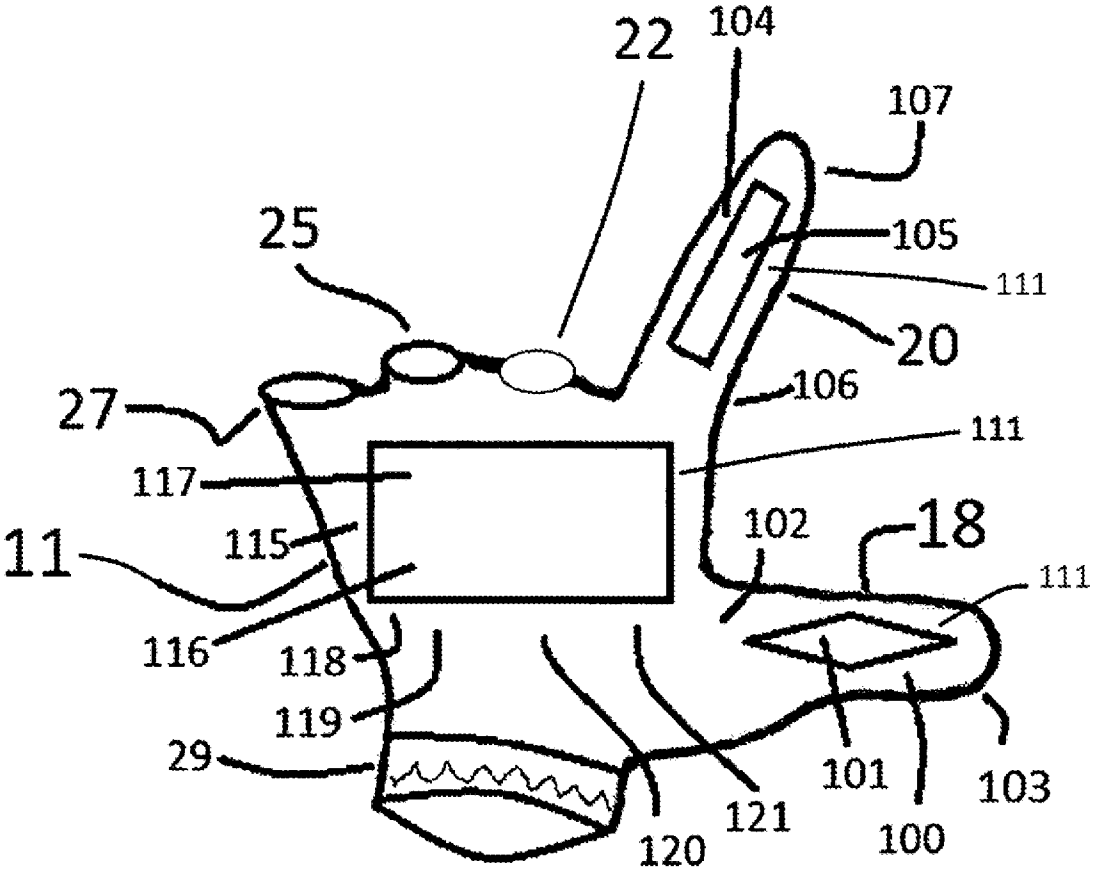
FIG. 8 is a drawing of an alternative dorsal segment to FIG. 1. Provided on the dorsal portion of the glove is a Shock-Absorbing Member.
Figure 9:
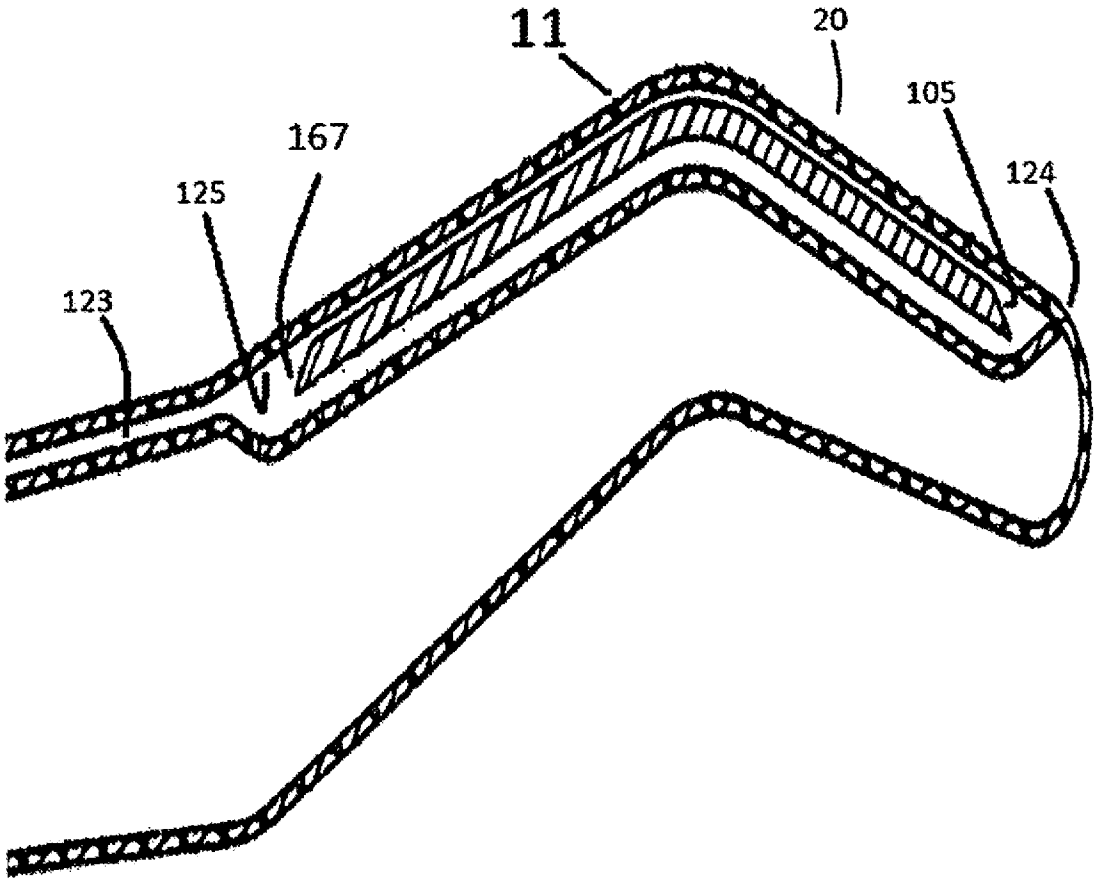
FIG. 9 is a cross-sectional view of FIG. 8, showing a liner.

FIG. 8 and FIG. 9 show an alternative dorsal segment to FIG. 1. Embodiments may also preferably comprise of a Shock-Absorbing Member 111 along any portion of the dorsal surface, such as any or all existing finger or thumb stalls, along the dorsal surface overlaying any or all of the metacarpals, along any of the carpometacarpal joints, or combinations thereof. In the illustrated embodiment, a Shock-Absorbing Member is secured along substantially all of the dorsal surface overlaying the thumb 18. The Shock-Absorbing Member overlaying the thumb is in the pattern of a diamond 100, and is configured as a one pad segment 101. Other embodiments may prefer to may do so as separate padding segments, for example, to allow for significant finger flexibility by having one pad overlaying only the proximal phalanx, and a second pad overlaying only the distal phalanx of the thumb. By not covering any of the thumb joints you have added flexibility but less protection.

The length of the Shock-Absorbing Member of this embodiment is further restricted to the length of the thumb segment extending from the glove 102 and 103 and, as mentioned, the dorsal surface area of the thumb segment 18—allowing for the Shock-Absorbing Member to extend circumferentially along the sides of the thumb segment but not extending onto the palmar surface of the thumb segment, therefore not extending over one hundred and eighty degrees of the digital segment.

This embodiment also has a Shock-Absorbing Member along substantially all of the dorsal surface overlaying the forefinger 20. The Shock-Absorbing Member overlaying the forefinger is in the pattern of a rectangle 104, and is configured as a one pad segment 105. Other embodiments may prefer to may do so as separate padding segments, for example, to allow for significant finger flexibility by having one pad overlaying only the proximal phalanx, a second pad overlaying only the middle phalanx, and a third pad overlaying only the distal phalanx of the forefinger. By not covering any of the forefinger joints you have added flexibility but less protection.

The length of the Shock-Absorbing Member of this embodiment is further restricted to the length of the forefinger segment 106 and 107 extending from the glove and, as mentioned, the dorsal surface area of the forefinger segment 20—allowing for the Shock-Absorbing Member to extend circumferentially along the sides of the forefinger segment but not extending onto the palmar surface of the forefinger segment. The thickness of this and other padding in this embodiment may vary, at least about ¼ inch in thickness, and made of any material aforementioned.

This embodiment also has a Shock-Absorbing Member 111 along substantially all of the dorsal surface overlaying the metacarpals of a user's four fingers 115. The Shock-Absorbing Member overlaying the four metacarpals is in the pattern of a rectangle 116, and is configured as a one pad segment 117. Other embodiments may prefer to comprise of padding segments overlaying this area, for example, to allow for significant finger flexibility by having one pad overlaying only the top half of the metacarpals—the portion closest to the fingers, and a second pad overlaying the bottom half of the metacarpals—the portion closest to the wrist area. The length and width of the Shock-Absorbing Member of this embodiment is generally restricted to the dorsal portion of the glove overlaying the metacarpal bones of a user's hand 118, 119, 120, and 121, in part or in their entirety. Of course, users may prefer any combination of the aforementioned, and may also include a Shock-Absorbing Member secured to the thumb metacarpal bone. The thickness of this padded segment may preferably be ¼ inch or more to provide more protection than over the digital segments, especially if a quarterback rushes relatively often.

The Shock-Absorbing Members of this embodiment may comprise of a polyester fiber 101, 105, and 115, for example, of a neoprene material, or of any other material aforementioned.

As mentioned, the Shock-Absorbing Member may be affixed to the glove by any standard methods of attachment, such as by stitching or adhesion. For example, it can be in the form of pouches (as seen 122 of FIG. 6) or attachments to the glove, said pouches containing the Shock-Absorbing Member, and then bonding said pouches to the back of the glove, using heat sealing or other methods. The pouches may be constructed using standard material, such as flexible rubber or plastics, or made of the same material forming the dorsal surface of the glove.

As illustrated, the Shock-Absorbing Member is integral with the material that form the glove, and may be applied to select areas of the glove by standard methods such as, for example, by the dorsal segment 11 comprising of a vinyl sheet material with a stretch nylon backing and the liner (or sleeve) 123 made of a knit of polyester. The liner is positioned along the inner surface of the dorsal segment 125 of the glove whereby the padded layer 105 or layers would be inserted and then sealed. The cushions may also be secured to the glove by conventional stitching 124.

The liner 123 can be interposed between the Shock-Absorbing Member and the interior of the glove, and separate the Shock-Absorbing Member from the user's hand, fingers, thumb and metacarpals, such as disclosed above, and allow easy insertion of the user's hand. Preferably, the liner is fixed to the dorsal segment interior using methods known in the art, such as stitching, to fix the Shock-Absorbing Member to the glove. The liner secures the Shock-Absorbing Member between the user's hand and the dorsal segment. Of course, other methods of attachment that are known in the art may be used.

The Shock-Absorbing Member will give the user added protection from the abrasion from hitting the hand against the helmet of an opponent, for example. As shown, the present invention can offer the unique ability of being able to protect a hand while maintaining grip capabilities by offering padded layer or layers, a significant and substantial advancement to prior art, such as bandages and 'BAND-AID™', thus providing a solution to a long-felt need of being able to protect a quarterback's throwing hand.

The illustrated dorsal segment may be constructed of the same material as that of FIG. 2, or may be of a thicker, more durable material, such as a synthetic leather for added protection, or may be constructed with any other material aforementioned. The dorsal segment may be joined to the palmar segment, as described in FIG. 1 by methods known in the art such as by sewing, to form an opening for receiving the user's hand.

The wrist portion is preferably expansible so as to hold more securely to the user's wrist. Therefore the embodiment also has an expandable opening means 29 at a wrist end adapted to receive the user's hand. The expandable opening means comprises an elastic material along the wrist portion, such as an elastomeric band 29 fixed around the wrist. If desired, the opening means may comprise a strap means at the open end of the glove body for fastening the glove body secure about the wrist area. The strap means may be unitary with the glove body and may include 'VELCRO™' fasteners, buttons, and the like or other suitable closure means thereon.

FIG. 9 is a cross-sectional view of FIG. 8, showing the liner. Specifically, the illustration shows the forefinger stall 20, whereby the Shock-Absorbing Member 105 lies between the inner surface 125 of the dorsal segment 11 and the liner 123. The thickness of the Shock-Absorbing Member 105 can vary by user preference. The thickness of this embodiment is about ¼ inch for example. The Shock-Absorbing Member may be constructed with known material as those aforementioned, such as cotton, for example. Preferably, the liner is fixed to the dorsal segment interior using methods known in the art, such as stitching, to fix the Shock-Absorbing Member to the glove.

Figure 10:
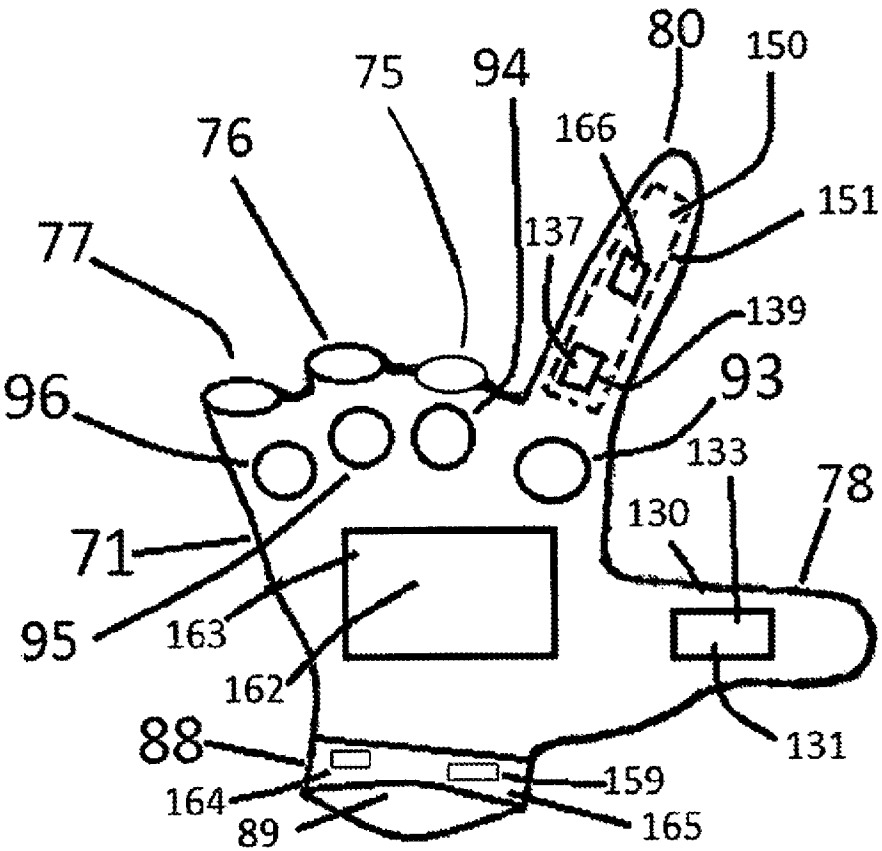
FIG. 10 is a drawing of an alternative dorsal segment to FIG. 5. Provided on the dorsal portion of the glove is a Shock-Absorbing Member.

FIG. 10 is an alternative dorsal segment to FIG. 5. Embodiments may also preferably comprise of a Shock-Absorbing Member along any portion of the dorsal surface, such as any or all existing finger or thumb stalls, along the dorsal surface overlaying any or all of the metacarpals, or combinations thereof. In the illustrated embodiment, the glove is constructed such that the thumb 78 and forefinger 80 digital segments enclose a user's thumb and forefinger, including enclosing the fingertips. As aforementioned, the glove does not cover any portion of a user's middle finger, ring finger of pinkie finger. The glove provides a separate ringlet opening for a user's middle finger 75, ring finger 76 and pinkie finger 77.

The dorsal section of the glove covers most of the back of the hand 71. The glove also has a wrist portion that surrounds the wrist of a user.

This embodiment has a Shock-Absorbing Member along substantially all of the proximal phalanx 130 dorsal surface overlaying the thumb 78. The Shock-Absorbing Member overlaying the thumb is in the pattern of a rectangle 131, and is configured as a one pad segment 131. Other embodiments may prefer to offer additional separate padding segments, for example, with a second pad overlaying only the distal phalanx of the thumb. The length of the Shock-Absorbing Member is further restricted to the length of the protrusion 133 along the proximal phalanx of the thumb stall, and, as mentioned, the dorsal surface area of the thumb segment 78—allowing for the Shock-Absorbing Member to extend circumferentially along the sides of the thumb segment but not extending onto the palmar surface of the thumb segment, therefore not extending over one hundred and eighty degrees of the digital segment.

This embodiment has a Shock-Absorbing Member 150 along substantially all of the dorsal surface overlaying the forefinger 80. The Shock-Absorbing Member overlaying the forefinger is in the pattern of a rectangle 151, is an elongated pad, and is configured as a one pad segment 151, and is defined by the length and width of the forefinger segment's dorsal surface.

This embodiment has a second layer Shock-Absorbing Member along substantially all of the proximal phalanx 136 dorsal surface overlaying the forefinger 80. The Shock-Absorbing Member overlaying the forefinger is in the pattern of a square 137, and is configured as a one pad segment 137. Other embodiments may prefer to offer additional separate padding segments, for example, with a second pad overlaying only the middle phalanx, and a third pad overlaying only the distal phalanx. The length of the second layer Shock-Absorbing Member is further restricted to the length of the protrusion 139 along the proximal phalanx on forefinger stall and, as mentioned, the dorsal surface area of the forefinger segment 80—allowing for the Shock-Absorbing Member to extend circumferentially along the sides of the thumb segment but not extending onto the palmar surface of the thumb segment, therefore not extending over one hundred and eighty degrees of the digital segment.

This embodiment also has a Shock-Absorbing Member along substantially all of the dorsal surface overlaying the metacarpals of a user's four fingers. The Shock-Absorbing Member overlaying the four metacarpals is in the pattern of a rectangle 163, and is configured as a one pad segment 162. Other embodiments may prefer to may do so as separate padding segments, for example, to allow for significant finger flexibility by having one pad encased and protruding from only the top half of the metacarpals—the portion closest to the fingers, and a second pad encased and protruding from the bottom half of the metacarpals—the portion closest to the wrist area. The length and width of the Shock-Absorbing Member is generally restricted to the protrusion on the dorsal portion of the glove overlaying the metacarpal bones of the hand, and can also include the thumb metacarpal, in part or in its entirety. Of course, users may prefer any combination of the aforementioned.

Finally, the wrist portion also comprises a Shock-Absorbing Member that protrudes on the dorsal segment 164 and 159, along about one inch of a user's carpals 165. This will give the user added protection from the abrasion along the carpometacarpal joints when hitting the ground or while the quarterback rushes with the football.

The Shock-Absorbing Members may comprise any type of cloth fabric, like a cushion, or foam, such as an open cell foam 150. The Shock-Absorbing Member need not be very thick, say beginning from about six hundred micrometers 150 to ¼ inch 167 or so. The thickness of pads for example may vary on several factors, of course, such as degree of preferred protection (e.g., the more a quarterback rushes with the football, the thicker padding he may desire) & location of the pads (e.g., padding on only the pinkie metacarpal where many quarterback hand injuries occur). Each Shock-Absorbing Member may comprise of one foam pad or a plurality of small pads to maximize flexibility. A second layer Shock-Absorbing Member may also be offered. The second (or multiple) layer may preferably be of the same material but also may be thicker or more resilient to better protrude.

The Shock-Absorbing Member may be stitched on or may be integral to the glove. This can be done by standard methods. The illustration shows the Shock-Absorbing Member integrally formed on the glove. For example, the dorsal segment of the glove 71 comprises preferably a flexible, integrally molded member which has a tougher outer protective membrane 71 and a smoother hand-contacting inner membrane, such as a liner 170 or sleeve, membranes 71 and 170 being connected together around the peripheral edge of the member 172. Inner membrane 170 is generally flat and outer membrane has one or a plurality of discreet shock-absorbing protective protrusions, 133, 139, 159, 163, 164, and 166.

For example, the Shock-Absorbing Member may comprise a thick layer of resilient plastic foam material, such as ½ inch polyethylene foam sheet, which is interposed between outer membrane and inner membrane to provide a composite laminated sheet which is then molded. Outer membrane is of a suitable plastic material such as vinyl sheet material with a stretch nylon backing. Inner membrane is preferably of double knit polyester or other suitable textile material to minimize abrasion of hand. The composite laminate sheet can then be molded to form the spacing between protrusions, by pressing outer membrane toward inner membrane. The dimensions of the compartments (or protrusions) would be of sufficient manner to house the pads.

The wrist portion is preferably expansible so as to hold more securely to the user's wrist. Therefore the embodiment also has an expandable opening means 88 at a wrist end 89 adapted to receive the user's hand. The expandable opening means comprises an elastic material along the wrist portion, such as an elastomeric band 88 fixed around the wrist. If desired, the expandable opening means may comprise a strap means at the open end of the glove body for fastening the glove body secure about the wrist area. The strap means may comprise two pads of cohesive-adhesive material for releasably securing the strap, for example. The strap as well as the wrist portion may be sewn onto the glove.

Additionally, this embodiment is configured such that a second protrusion exists on the proximal interphalangeal joint of the forefinger's dorsal surface 166. This protrusion does not contain a second Shock-Absorbing Member thus providing the user with added flexibility capabilities along the interphalangeal joint of the forefinger, especially beneficial if the dorsal segment is generally constructed with a more durable material, such as a leather latex glove.

Furthermore, embodiments such as this may be coated with a water repellant substance throughout the glove, such as a synthetic resin, for example. This feature will further enhance a user's ability to maintain control of a football during rainy conditions.

Figure 11:
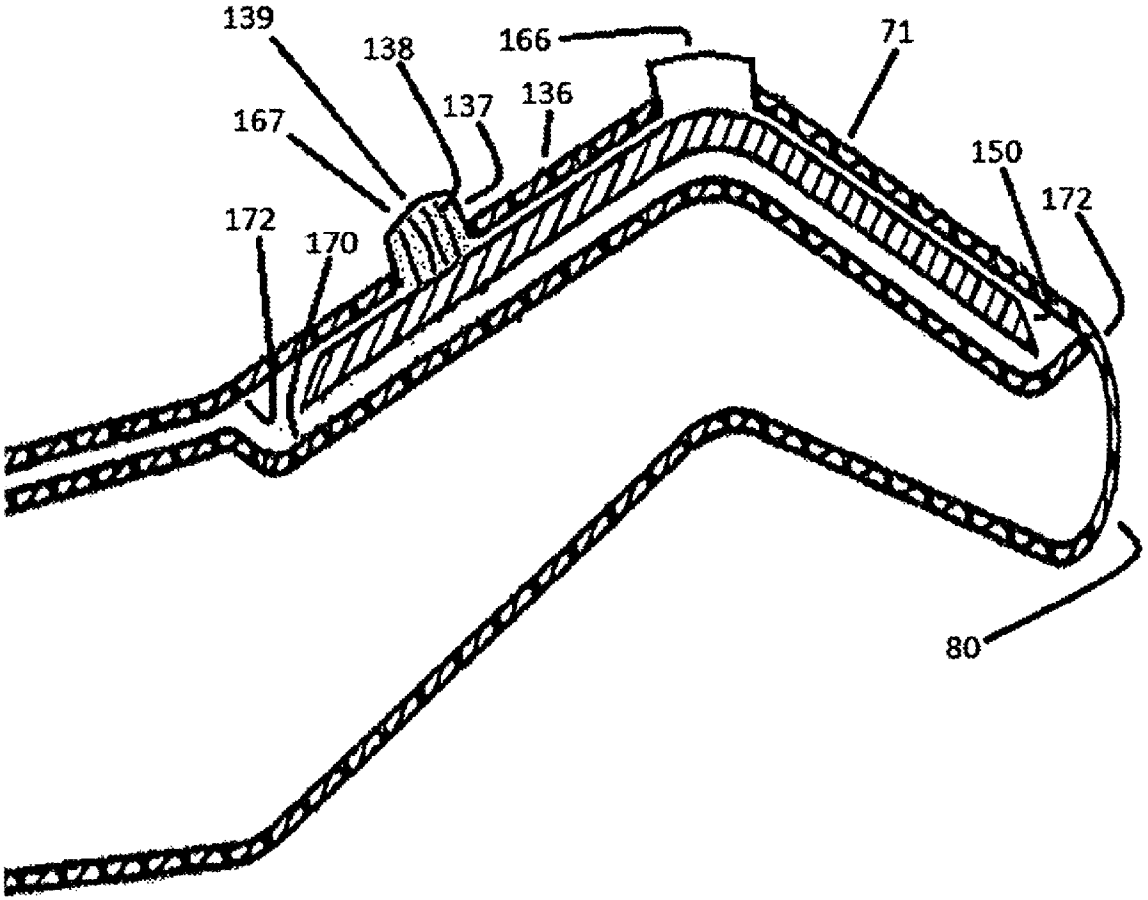
FIG. 11 is a cross-sectional view of FIG. 10, showing a liner and protrusions.

FIG. 11 is a cross-sectional view of FIG. 10, showing the liner and protrusions. Specifically, the illustration shows the forefinger stall 80, whereby the Shock-Absorbing Member 150 lies between the inner surface 172 of the dorsal segment 71 and the liner 170. The thickness of the Shock-Absorbing Member can vary by user preference, such as about ¼ inch for example. The Shock-Absorbing Member may be constructed with known material and those aforementioned, such as cotton, for example. Preferably, the liner is fixed to the dorsal segment interior using methods known in the art, such as stitching, to fix the Shock-Absorbing Member to the glove.

This embodiment has a second layer Shock-Absorbing Member along, and is bounded by, the proximal phalanx 136 dorsal surface overlaying the forefinger 80. The Shock-Absorbing Member overlaying the forefinger is in the pattern of a square 137, and is configured as a one pad segment 138. Other embodiments may prefer to offer additional separate padding segments, for example, with a second pad overlaying only the middle phalanx, and a third pad overlaying only the distal phalanx. The length of the second layer Shock-Absorbing Member is further restricted to the protrusion 139 along the proximal phalanx on forefinger segment, say about 0.20 inch or more in height for example and, as mentioned, the dorsal surface area of the forefinger segment 80—allowing for the Shock-Absorbing Member to extend circumferentially along the sides of the thumb segment but not extending onto the palmar surface of the thumb segment, therefore not extending over one hundred and eighty degrees of the digital segment.

Additionally, the embodiment is configured such that a second protrusion exists on the proximal interphalangeal joint of the forefinger's dorsal surface 166. This protrusion does not contain a second Shock-Absorbing Member thus providing the user with added flexibility capabilities along the interphalangeal joint, especially beneficial if the dorsal segment is generally constructed with a more durable material, such as a leather latex glove.

Also, the liner may be made of a fleece material 170 thus offering additional comfort and warmth for the user, especially during rainy conditions.

Figure 12:
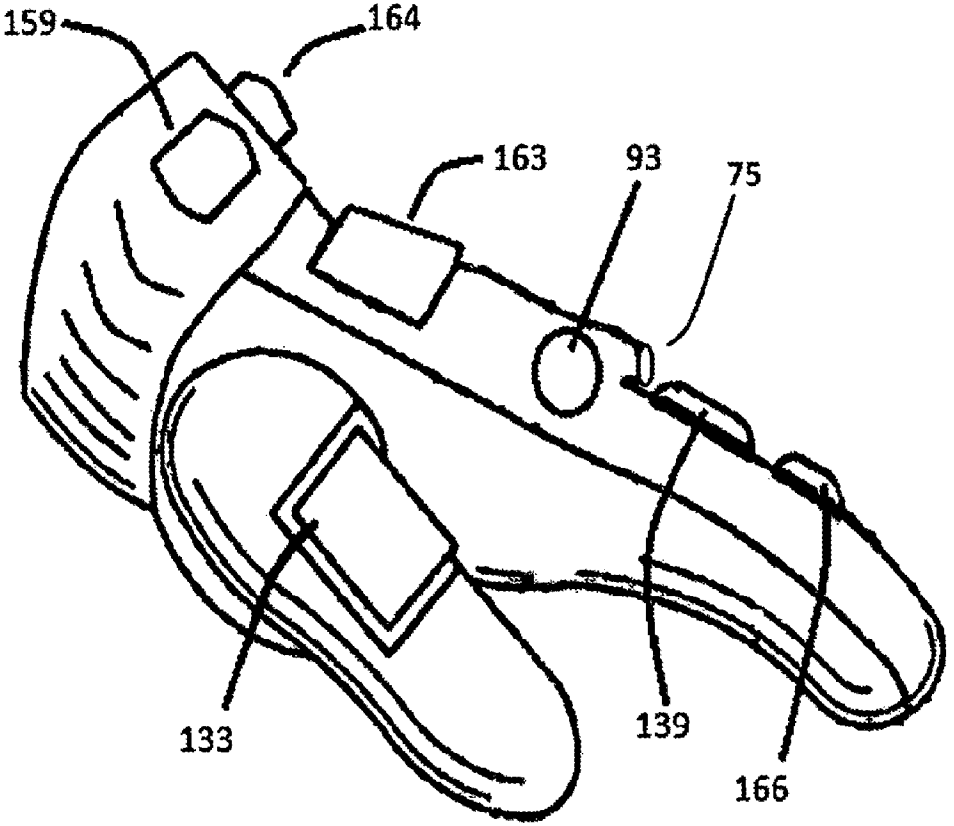
FIG. 12 is a side view of the glove embodiment comprised of FIG. 10 (dorsal segment) and FIG. 5 (palmar segment).

FIG. 12 is a side view of the glove embodiment comprised of FIG. 10 (dorsal segment) and FIG. 5 (palmar segment). The illustration shows the protrusion on the thumb stall 133, the protrusions on the forefinger stall 139 and 166, the protrusion on the four finger metacarpals 163, and the protrusions on the wrist segment 159 and 164. The protrusions may have various dimensions of course. The illustrated protrusions have a height of about 0.20 of an inch, for example. As mentioned, this embodiment could also prove beneficial with the apertures on the knuckles 93, 94, 95, and 96.

Figure 13:
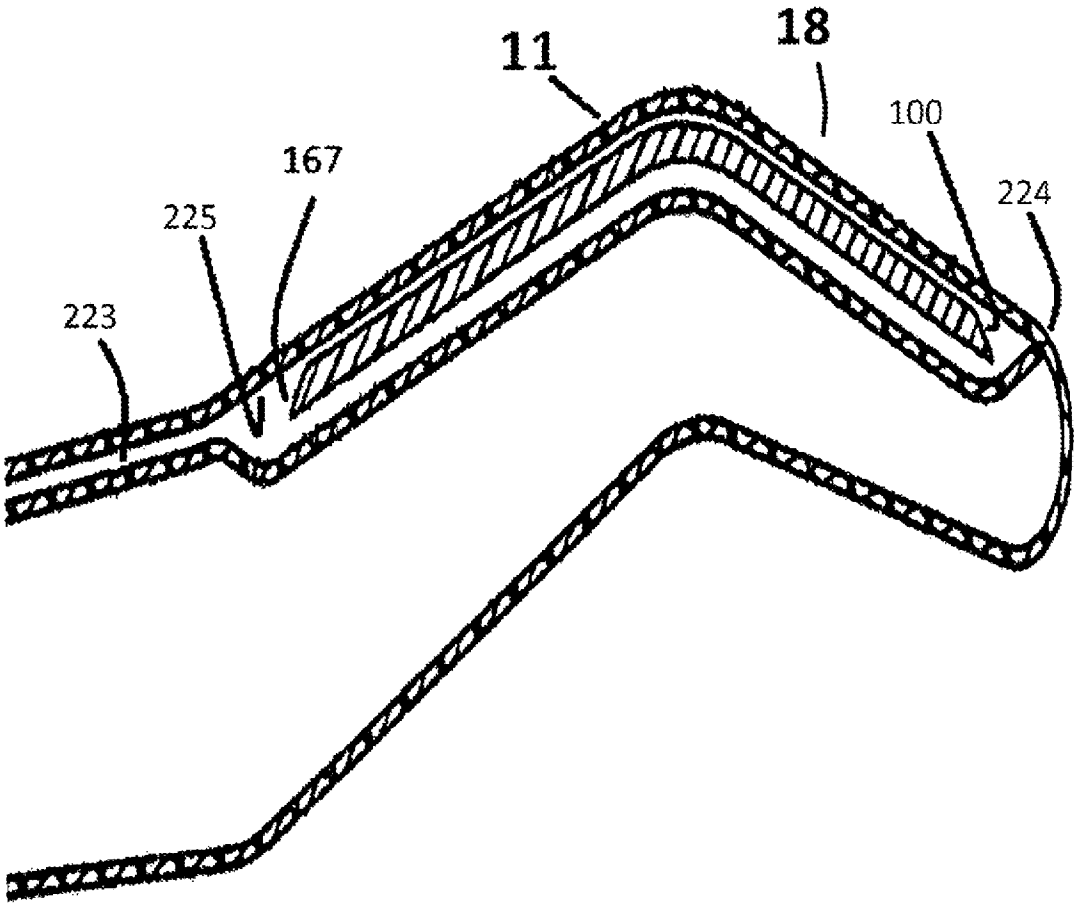
FIG. 13 is a cross-sectional view of FIG. 8, showing a liner.

FIG. 13 is another cross-sectional view of FIG. 8, showing the liner. Specifically, the illustration shows the thumb stall 18, whereby the Shock-Absorbing Member 100 lies between the inner surface 225 of the dorsal segment 11 and the liner 223. The thickness of the Shock-Absorbing Member 100 can vary by user preference. The thickness of this embodiment is about ¼ inch for example. The Shock-Absorbing Member may be constructed with known material as those aforementioned, such as cotton, for example. Preferably, the liner is fixed to the dorsal segment interior using methods known in the art, such as stitching, to fix the Shock-Absorbing Member to the glove.

In the illustrated embodiment, a Shock-Absorbing Member is secured along substantially all of the dorsal surface overlaying the thumb 18. The Shock-Absorbing Member overlaying the thumb is in the pattern of a diamond 100, and is configured as a one pad segment 101. Other embodiments may prefer to may do so as separate padding segments, for example, to allow for significant finger flexibility by having one pad overlaying only the proximal phalanx, and a second pad overlaying only the distal phalanx of the thumb. By not covering any of the thumb joints you have added flexibility but less protection.

As illustrated, the Shock-Absorbing Member is integral with the material that form the glove, and may be applied to select areas of the glove by standard methods such as, for example, by the dorsal segment 11 comprising of a vinyl sheet material with a stretch nylon backing and the liner (or sleeve) 223 made of a knit of polyester. The liner is positioned along the inner surface of the dorsal segment 225 of the glove whereby the padded layer 100 or layers would be inserted and then sealed. The cushions may also be secured to the glove by conventional stitching 224.

The liner 223 can be interposed between the Shock-Absorbing Member and the interior of the glove, and separate the Shock-Absorbing Member from the user's hand, fingers, thumb and metacarpals, such as disclosed above, and allow easy insertion of the user's hand. Preferably, the liner is fixed to the dorsal segment interior using methods known in the art, such as stitching, to fix the Shock-Absorbing Member to the glove. The liner secures the Shock-Absorbing Member between the user's hand and the dorsal segment. Of course, other methods of attachment that are known in the art may be used.

Figure 14:
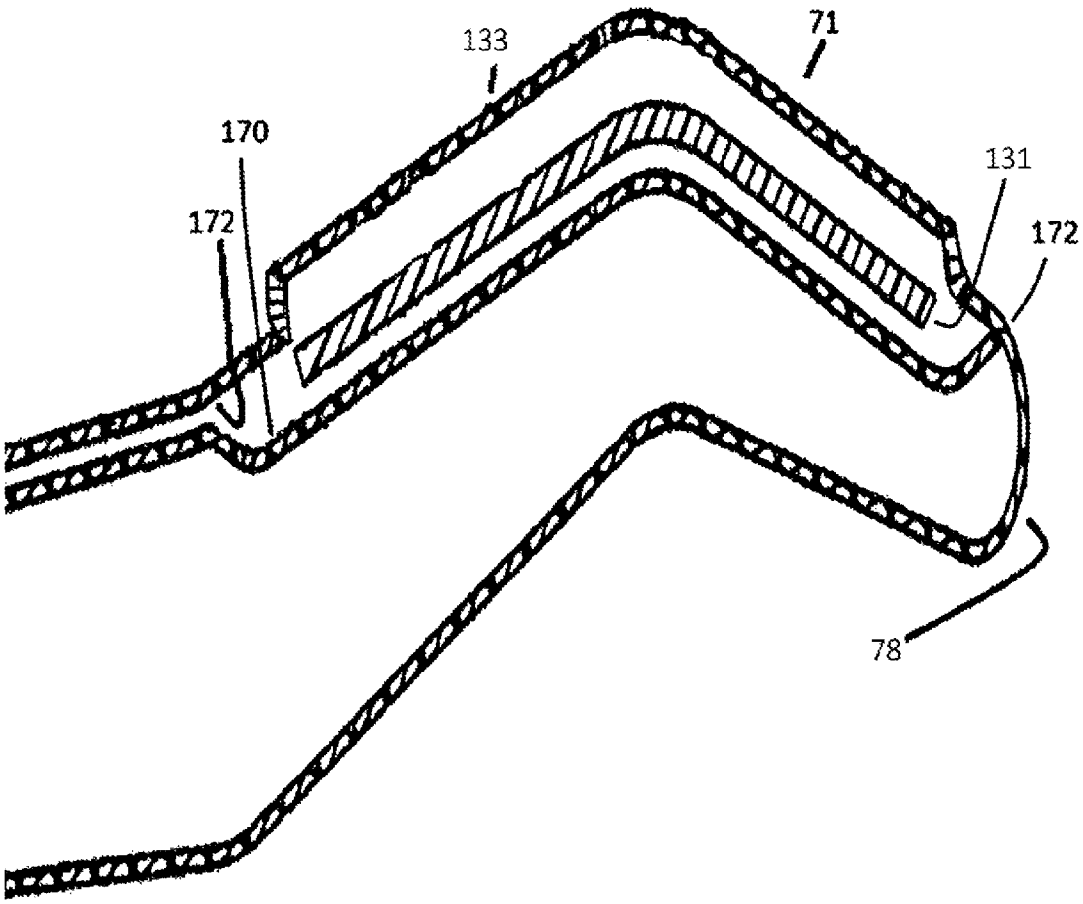
FIG. 14 is a cross-sectional view of FIG. 10, showing a liner and protrusions.

FIG. 14 is another cross-sectional view of FIG. 10, showing the liner and protrusions. Specifically, the illustration shows the thumb stall 78, whereby the Shock-Absorbing Member 131 lies between the inner surface 172 of the dorsal segment 71 and the liner 170. The thickness of the Shock-Absorbing Member can vary by user preference, such as about ¼ inch for example. The Shock-Absorbing Member may be constructed with known material and those aforementioned, such as cotton, for example. Preferably, the liner is fixed to the dorsal segment interior using methods known in the art, such as stitching, to fix the Shock-Absorbing Member to the glove.

Additionally, the embodiment may be configured such that a second protrusion exists on the proximal interphalangeal joint of the thumb's dorsal surface. This protrusion would not contain a second Shock-Absorbing Member thus providing the user with added flexibility capabilities along the interphalangeal joint, especially beneficial if the dorsal segment is generally constructed with a more durable material, such as a leather latex glove.

Also, the liner may be made of a fleece material 170 thus offering additional comfort and warmth for the user, especially during rainy conditions.

I claim:

1. A glove with a glove body having dorsal and palmar portions for overlaying respective back and palm regions of a human hand, said dorsal and palmar portions each having distal and proximal ends with a plurality of digital stalls extending from said distal ends, wherein the proximal ends of the dorsal and palmar portions collectively define a glove body proximal end and the distal ends of the dorsal and palmar portions collectively define a glove body distal end;

said dorsal portion is configured to cover the back of the hand, and said palmar portion is configured to cover the palm of the hand;

said plurality of digital stalls includes a forefinger finger stall and a thumb stall each adapted to receive a forefinger and thumb of a user's hand, respectively, therein;

said glove body being configured such that when the glove is worn, said forefinger stall and said thumb stall fully enclose said forefinger and thumb, including enclosing the fingertips of said forefinger and thumb of the user, respectively;

three separate ringlets are provided on said glove body distal end, such that when the glove is worn, the user's ring finger, pinkie finger, and middle finger individually extend through said ringlets;

wherein said glove is configured to leave essentially completely uncovered the ring finger;

wherein said glove is configured to leave essentially completely uncovered the pinkie finger;

wherein said glove is configured to leave uncovered, is configured to fully enclose or configured to partially cover the middle finger;

wherein said glove further comprises of a grip enhancing means on at least a portion of a surface area of the glove;

wherein said grip enhancing means is comprised of a plurality of projections;

wherein said plurality of projections consists of at least twenty-one projections;

wherein each of said plurality of projections is at least 100 micrometers in height.

2. The glove as claimed in claim 1, wherein said glove further comprises of a plurality of micro recesses on said glove; wherein said micro recesses are disposed on a portion of the surface of said glove body, for moisture management purposes.

3. The glove as claimed in claim 1, wherein said glove is coated with a water repellant substance to provide a glove that is adapted for active, outdoor sports play.

4. The glove as claimed in claim 1, wherein said grip enhancing means are disposed along the surface area of the palmar portion adapted to overlay the user's palm.

5. The glove as claimed in claim 1, wherein said grip enhancing means are disposed along the forefinger finger stall surface area adapted to overlay the user's forefinger.

6. The glove as claimed in claim 1, wherein said plurality of projections are spaced apart for added grip and flexibility; and wherein said glove body further comprises of a wrist portion that is adapted to surround the wrist of the user;

wherein said wrist portion comprises of an expandable opening means at a wrist end that is configured to be expansible so as to hold said glove securely to the user's wrist.

7. The glove as claimed in claim 1, wherein said grip enhancing means is disposed along the thumb stall surface area adapted to overlay the user's thumb.

8. A glove with a glove body having dorsal and palmar portions for overlaying respective back and palm regions of a human hand, said dorsal and palmar portions each having distal and proximal ends with a plurality of digital stalls extending from said distal ends, each having a palmar and dorsal portion, wherein the proximal ends of the dorsal and palmar portions collectively define a glove body proximal end and the distal ends of the dorsal and palmar portions collectively define a glove body distal end;

said dorsal portion is configured to cover the back of the hand, and said palmar portion is configured to cover the palm of the hand;

said plurality of digital stalls includes a forefinger finger stall and a thumb stall each adapted to receive a forefinger and thumb, respectively, therein;

said glove body being configured such that when the glove is worn, said forefinger stall and thumb stall fully enclose said forefinger and said thumb, including enclosing the fingertips of said forefinger and thumb of the user, respectively;

three separate ringlets are provided on said glove body distal end, such that when the glove is worn, a user's ring finger and pinkie finger extend through two of said ringlets and are each fully exposed, whereby the skin of said fingers can make contact with a sporting device or ball;

wherein said glove is configured to leave completely uncovered the ring finger;

wherein said glove is configured to leave completely uncovered the pinkie finger;

wherein said glove is configured to leave uncovered, is configured to fully enclose or configured to partially cover the middle finger;

wherein said glove further comprises of a grip enhancing means on at least a portion of a surface area of the palmar portion adapted to overlay the user's palm;

wherein said grip enhancing means is comprised of a plurality of projections;

wherein said plurality of projections consists of at least twenty-one projections;

wherein each of said plurality of projections is at least 100 micrometers in height.

9. The glove as claimed in claim 8, wherein said grip enhancing means is adapted to overlay throughout the entire palm region of the user's hand.

10. The glove as claimed in claim 8, wherein said thumb stall further consists of a thumb gripping means in the form of at least twenty-one projections such that said thumb gripping means is disposed on the thumb stall palmar portion.

11. The glove as claimed in claim 8, wherein said forefinger finger stall further consists of a forefinger grip enhancing means in the form of at least twenty-one projections such that the forefinger grip enhancing means is configured to overlay the forefinger of the user.

12. The glove as claimed in claim 8, wherein said thumb stall further consists of a thumb grip enhancing means in the form of at least twenty-one projections.

13. The glove as claimed in claim 8, wherein said grip enhancing means is formed from a PVC material, a latex material or a rubber material.

* * * * *